US006484700B1

(12) United States Patent
Kimmel et al.

(10) Patent No.: US 6,484,700 B1
(45) **Date of Patent: *Nov. 26, 2002**

(54) AIR ASSIST FUEL INJECTORS

(75) Inventors: James Allen Kimmel, Williamsburg, VA (US); Scott P. Dillon, Newport News, VA (US)

(73) Assignee: Synerject, LLC, Newport News, VA (US)

( * ) Notice: Subject to any disclaimer, the term of this patent is extended or adjusted under 35 U.S.C. 154(b) by 22 days.

This patent is subject to a terminal disclaimer.

(21) Appl. No.: 09/644,799

(22) Filed: Aug. 24, 2000

(51) Int. Cl.[7] ..... F02M 23/00; F02M 51/00

(52) U.S. Cl. ..... 123/531; 239/585.1; 239/408; 251/129.21

(58) Field of Search ..... 123/531, 296, 123/297; 251/129.1, 129.14, 129.15, 129.16, 129.21, 129.22; 239/585.1, 585.3, 585.5, 408

(56) References Cited

U.S. PATENT DOCUMENTS

| | | | |
|---|---|---|---|
| 3,300,672 | A | 1/1967 | Fisher |
| 4,124,003 | A | 11/1978 | Abe et al. |
| 4,434,766 | A | 3/1984 | Matsuoka et al. |
| 4,462,760 | A | 7/1984 | Sarich et al. |
| 4,516,548 | A | 5/1985 | May |
| 4,519,356 | A | 5/1985 | Sarich |
| 4,527,520 | A | 7/1985 | Koch |
| 4,554,945 | A | 11/1985 | McKay |
| 4,561,405 | A | 12/1985 | Simons |
| 4,674,462 | A | 6/1987 | Koch et al. |
| 4,693,224 | A | 9/1987 | McKay |
| 4,712,524 | A | 12/1987 | Smith et al. |
| 4,719,880 | A | 1/1988 | Schlunke et al. |
| 4,753,213 | A | 6/1988 | Schlunke et al. |
| 4,754,735 | A | 7/1988 | Simons |
| 4,754,739 | A | 7/1988 | Czwienczek et al. |
| 4,759,335 | A | 7/1988 | Ragg et al. |
| 4,760,832 | A | 8/1988 | Smith et al. |
| 4,781,164 | A | 11/1988 | Seeber et al. |
| 4,790,270 | A | 12/1988 | McKay et al. |

(List continued on next page.)

FOREIGN PATENT DOCUMENTS

| | | |
|---|---|---|
| AU | B1-21034/77 | 7/1978 |
| AU | B1-26285/77 | 1/1979 |
| AU | B-62857/80 | 4/1981 |

(List continued on next page.)

OTHER PUBLICATIONS

Sam Leighton et al., "The Orbital Combustion Process for Future Small Two–Stroke Engines", Presented at Institut Francais du Petrole International Seminar: A New Generation of Two–Stroke Engines for the Future?, Rueil Malmaison, France, Nov. 29–30, 1993.

(List continued on next page.)

*Primary Examiner*—Hieu T. Vo
(74) *Attorney, Agent, or Firm*—Cooley Godward LLP

(57) ABSTRACT

An air assist fuel injector having an armature and a solenoid for actuating the armature. The armature includes a conduit having a conical portion for delivering liquid fuel and gas to a poppet of the air assist fuel injector. The conduit includes an inlet for receiving the liquid fuel and gas from a cap of the air assist fuel injector. The cap includes a number of channels for delivering the liquid fuel and gas, and the outlets of the channels are located radially inward of the periphery of the inlet to the armature conduit. The armature also includes a flow path located between an area upstream of the inlet to the armature and an area downstream of the armature. The flow path may include one or more recesses in the armature or one or more recesses in an armature guide of the air assist fuel injector.

53 Claims, 24 Drawing Sheets

U.S. PATENT DOCUMENTS 4,794,901 A 1/1989 Hong et al.
4,794,902 A 1/1989 McKay
4,800,862 A 1/1989 McKay et al.
4,803,968 A 2/1989 Czwienczek et al.
4,807,572 A 2/1989 Schlunke
4,817,873 A 4/1989 McKay
4,825,828 A 5/1989 Schlunke et al.
4,841,942 A 6/1989 McKay
4,844,040 A 7/1989 Leighton et al.
4,844,339 A 7/1989 Sayer et al.
4,867,128 A 9/1989 Ragg et al.
4,886,021 A 12/1989 Seeber et al.
4,886,120 A 12/1989 Shupe
4,901,687 A 2/1990 Jones
4,920,745 A 5/1990 Gilbert
4,920,932 A 5/1990 Schlunke
4,924,820 A 5/1990 Lear et al.
4,926,806 A 5/1990 Ahern et al.
4,934,329 A 6/1990 Lear et al.
4,936,279 A 6/1990 Ragg
4,938,178 A 7/1990 Schlunke et al.
4,945,886 A 8/1990 McKay et al.
4,949,689 A 8/1990 Schlunke
4,989,557 A 2/1991 Penney
4,993,394 A 2/1991 McKay et al.
5,018,498 A 5/1991 Hoover
5,024,202 A 6/1991 McKay
5,090,625 A 2/1992 Davis
5,091,672 A 2/1992 Below
5,094,217 A 3/1992 Kaku et al.
5,113,829 A 5/1992 Motoyama
5,115,786 A 5/1992 Yamada
5,123,399 A 6/1992 Motoyama et al.
5,143,291 A * 9/1992 Grinsteiner ..... 239/585.1
5,150,836 A 9/1992 McKay et al.
5,163,405 A 11/1992 Ahern et al.
5,170,766 A 12/1992 Haas et al.
5,195,482 A 3/1993 Smith
5,205,254 A 4/1993 Ito et al.
5,209,200 A 5/1993 Ahern et al.
5,220,301 A 6/1993 Haas et al.
5,245,974 A 9/1993 Watson et al.
5,251,597 A 10/1993 Smith et al.
5,265,418 A 11/1993 Smith
5,267,545 A 12/1993 Kitson
5,279,327 A 1/1994 Alsobrooks et al.
5,291,822 A 3/1994 Alsobrooks et al.
5,315,968 A 5/1994 Niebrzydoski
5,358,181 A 10/1994 Tani et al.
5,377,630 A 1/1995 Schlunke et al.
5,377,637 A 1/1995 Leighton et al.
5,379,731 A 1/1995 Sayer
5,381,816 A 1/1995 Alsobrooks et al.
5,392,828 A 2/1995 Watson et al.
5,398,654 A 3/1995 Niebrzydoski
5,403,211 A 4/1995 Sayer et al.
RE34,945 E 5/1995 Sayer et al.
5,427,083 A 6/1995 Ahern
5,441,019 A 8/1995 Sayer et al.
5,477,833 A 12/1995 Leighton
5,477,838 A 12/1995 Schlunke et al.
5,483,944 A 1/1996 Leighton et al.
5,516,309 A 5/1996 Sayer et al.
5,527,150 A 6/1996 Windhofer
5,531,206 A 7/1996 Kitson et al.
5,540,205 A 7/1996 Davis et al.
5,546,902 A 8/1996 Paluch et al.
5,551,638 A 9/1996 Caley
5,558,070 A 9/1996 Bell et al.
5,560,328 A 10/1996 Bell et al.
5,588,415 A 12/1996 Ahern
5,593,095 A 1/1997 Davis et al.
5,606,951 A 3/1997 Southern et al.
5,615,643 A 4/1997 Hill
5,622,155 A 4/1997 Ellwood et al.
5,655,365 A 8/1997 Worth et al.
5,655,715 A 8/1997 Hans et al.
5,685,492 A 11/1997 Davis et al.
5,692,723 A 12/1997 Baxter et al.
5,694,906 A 12/1997 Lange et al.
5,709,177 A 1/1998 Worth et al.
5,730,108 A * 3/1998 Hill ..... 123/531
5,730,367 A 3/1998 Pace et al.
5,752,689 A * 5/1998 Barkhimer et al. ..... 239/585.4
5,794,600 A 8/1998 Hill
5,803,027 A 9/1998 Bell et al.
5,806,304 A 9/1998 Price et al.
5,819,706 A 10/1998 Tsuchida et al.
5,829,407 A 11/1998 Watson et al.
5,832,881 A 11/1998 Karay et al.
5,833,142 A 11/1998 Caley
5,853,306 A 12/1998 Worth et al.
5,863,277 A 1/1999 Melbourne
5,899,191 A 5/1999 Rabbit et al.
5,904,126 A 5/1999 McKay et al.
5,906,190 A 5/1999 Hole et al.
5,927,238 A 7/1999 Watson
5,941,210 A 8/1999 Hill et al.
5,970,954 A 10/1999 Worth et al.
5,971,300 A * 10/1999 Coldren et al. ..... 239/533.2
5,979,402 A 11/1999 Melbourne
5,979,786 A 11/1999 Longman et al.
5,983,865 A 11/1999 Yamashita et al.
6,062,499 A 5/2000 Nakamura et al.
6,302,337 B1 * 10/2001 Kimmel ..... 239/585.1

FOREIGN PATENT DOCUMENTS

AU B-66453/81 8/1981
AU A1-71108/81 12/1981
AU A-54978/90 1/1991
AU A-45546/96 11/1996
DE 38 28 764 A1 3/1990
FR 2763639 A1 11/1998
WO WO 87/00583 1/1987
WO WO 91/11609 8/1991
WO WO 93/23662 11/1993
WO WO 94/15094 7/1994
WO WO 94/28299 12/1994
WO WO 94/28300 12/1994
WO WO 95/01503 1/1995
WO WO 95/11377 4/1995
WO WO 95/26462 10/1995
WO WO 97/02424 1/1997
WO WO 97/02425 1/1997
WO WO 97/09520 3/1997
WO WO 97/12138 4/1997
WO WO 97/19358 5/1997
WO WO 97/22784 6/1997
WO WO 97/22852 6/1997
WO WO 98/01230 1/1998
WO WO 98/01659 1/1998
WO WO 98/01660 1/1998
WO WO 98/01663 1/1998
WO WO 98/01667 1/1998
WO WO 98/05861 2/1998
WO WO 99/20895 4/1999
WO WO 99/28621 6/1999
WO WO 99/42711 8/1999
WO WO 99/58846 11/1999
WO WO 99/58847 11/1999
WO WO 00/43666 7/2000

OTHER PUBLICATIONS

Sam Leighton et al., "The OCP Small Engine Fuel Injection System for Future Two–Stroke Marine Engines", SAE Paper 941687, Presented at Society of Automotive Engineers International Off–Highway and Powerplant Congress & Exposition, Milwaukee, Wisconsin, USA, Sep. 12, 1994.

Karl Eisenhauer, "Durability Development of an Automotive Two–Stroke Engine", Presentation at 2$^{nd}$ International Seminar "High Performance Spark Ignition Engines for Passenger Cars", Balsamo, Italy, Nov. 23–24, 1995.

Rod Houston et al., "Development of a Durable Emissions Control System for an Automotive Two–Stroke Engine", SAE Paper 960361, The Society of Automotive Engineers Congress, Detroit, Michigan, Feb. 26–29, 1996.

Nicholas Coplin, "Application of Air Assisted Direct Injection to High Performance Sports Motorcycles", Presented to the Petroleum Authority of Thailand at Seminar on "Engine Technologies to Reduce Emissions from Motorcycles", Mar. 21, 1996, PTT, Bangkok, Thailand.

Greg Bell et al., "Exhaust Emissions Sensitivities with Direct Injection on a 50cc Scooter", SAE Paper 970365, Presented at Society of Automotive Engineers SAE International Congress and Exposition, Detroit Michigan, USA Feb. 24, 1997.

Dave Worth et al., "Design Considerations for the Application of Air Assisted Direct In–Cylinder Injection Systems", SAE Paper 972074, Presented by Nicholas Coplin to the Small Engine Technology Conference in Yokohama, Japan, Oct. 28, 1997.

David Shawcross et al., "Indonesia's Maleo Car, Spearheads Production of a Clean, Efficient and Low Cost, Direct Injected Two–Stroke Engine", Presented at the IPC9 Conference, Nov. 16–21, 1997, Nusa Dua, Bali, Indonesia.

Dr. Rodney Houston et al., "Direct Injection 4–Stroke Gasoline Engines, the Orbital Combustion Process Solution", Presented at ImechE Euro IV Challenge Future Technologies and Systems Conference, Dec. 4, 1997.

David Shawcross et al., "A Five–Million Kilometre, 100–Vehicle Fleet Trial, of an Air–Assist Direct Fuel Injected, Automotive 2–Stroke Engine", Society of Automotive Engineers, Inc., 1999.

David Shawcross, "A High Mileage Extended Duration Fleet Trial of Orbital's Direct Fuel Injection Automotive Two–Stroke Engine", Presentation at Engine Expo 99, Hamburg, Germnay, Jun. 8–10, 1999.

Dr. Herbert Stocker et al., "Air Assisted Gasoline Direct Injection", Presented at Eurogress Aachen–Automobile and Engine Technology Conference, Aachen, Germany, Oct. 5–7, 1998.

Ramon Newmann, "Orbital's Air Assisted Direct Injection Combustion Applied to the Automotive Multi–Cylinder Gasoline Four–Stroke Engine", Presentation at Engine Expo 99, Hamburg, Germany, Jun. 1999.

Nicholas Coplin, "Simplification of Air Assisted Direct Injection via Performance Benchmarking", Presented at the Small Engine Technology Conference, Madison, Wisconsin, Oct. 29, 1999.

"On the Road to DI Fuel Economy Gains" Orbital Direct Injection, A Technology Update from the Orbital Engine Corporation, Mar. 2000.

Nicholas Coplin, "Air Assisted Gasoline Direct Injection—A Breath of Fresh Air", Presentation at Engine Expo 2000, Hamburg, Germany, Jun. 2000.

"A Breath of Fresh Air—Air Assisted Direct Fuel Injection—the System of Choice for Low Emissions and Good Fuel Economy", Orbital Engine Corporation, Presented at the Society of Automotive Engineers Congress, Detroit Michigan, Mar. 6–9, 2000.

Geoffrey Cathcart et al., "Fundamental Characteristics of an Air–Assisted Direct Injection Combustion System as Applied to 4 Stroke Automotive Gasoline Engines", Presented at Society of Automotive Engineers Congress, Mar. 6–9, 2000.

David R. Bowden et al., "NVH Characteristics of Air Assisted Direct Injection (DI) Spark Ignition Four Stroke Engines", Presented at the ImechE European Conference on Vehicle Noise and Vibration 2000, May 10–12, 2000.

Orbital, "Automotive 4–Stroke", *http://www.orbeng/com.au/tech/di4ssae.htm*.

Orbital, "Automotive 2–Stroke", *http://www.orbeng/com.au/tech/di2ssae.htm*.

Orbital, "Orbital Direct Injected Four Stroke Technology", pp. 1–2, Printed Apr. 15, 1999 http://www.orbeng/com.au/tech/di4ssae.htm.

Dr. Rodney Houston et al., "Direct Injection 4–Stroke Gasoline Engines, the Orbital Combustion Process Solution", presented at ImechE Euro IV Challenge Future Technologies and Systems Conference, Dec. 4, 1997, London, England, pp. 1–17.

Dave Worth et al., "Design Considerations for the Application of Air Assisted Direct In–Cylinder Injection Systems", SAE 972074, Presented by Nicholas Coplin to the Small Engine Technology Conference in Yokohama, Japan, Oct. 28, 1997, pp. 1–21.

* cited by examiner

AIR ASSIST FUEL INJECTORS

BACKGROUND OF THE INVENTION

1. Field of the Invention

The present invention relates to air assist fuel injectors and, more particularly, to the armatures of such air assist fuel injectors.

2. Description of the Related Art

Conventional fuel injectors are configured to deliver a quantity of fuel to a combustion cylinder of an engine. To increase combustion efficiency and decrease pollutants, it is desirable to atomize the delivered fuel. Generally speaking, atomization of fuel can be achieved by supplying high pressure fuel to conventional fuel injectors, or atomizing low pressure fuel with pressurized gas, i.e., "air assist fuel injection."

FIGS. 1 and 2 illustrate a conventional air assist fuel injector 50. The conventional air assist fuel injector 50 receives a metered quantity of low pressure fuel from a conventional fuel injector (not illustrated) and pressurized air from an air/fuel rail (not illustrated). The air assist fuel injector 50 atomizes the low pressure fuel with the pressurized air and conveys the air and fuel mixture to the combustion chamber of an engine.

The pressurized air from the air/fuel rail and the metered quantity of fuel from the conventional fuel injector enter the air assist fuel injector 50 through a cap 52, which delivers the fuel and air to a throughhole of an armature 54. Thereafter, the fuel and air travel through a passageway of a poppet 56, and exit the poppet through small slots near the end or head of the poppet. The poppet 56 is attached to the armature 54, which is actuated by energizing a solenoid 58. When the solenoid 58 is energized, the armature 54 will overcome the force of a spring 60 and move toward a leg 62. Because the poppet 56 is attached to the armature 54, the head of the poppet will lift off a seat 64 when the armature is actuated so that a metered quantity of atomized fuel is delivered to the combustion chamber of an engine.

As illustrated in FIG. 2, the throughhole of the armature 54 is enlarged at the end of the armature 54 facing the cap 52. This enlarged cylindrical volume receives a protrusion from the cap 52 and serves to pass the liquid fuel and air to the passageway of the poppet 56. As further illustrated in FIG. 2, it was conventionally thought to minimize the air volume between the armature 54 and the cap 52. However, this conventional construction often causes liquid fuel to accumulate between the cap 52 and the armature 54, which, in turn, causes poor transient response time between different fueling rates.

For example, if the air assist fuel injector 50 were installed in the engine of an automobile or motorcycle and the operator of the vehicle let off the throttle to slow down the vehicle, the amount of fuel supplied to the air assist fuel injector 50 would decrease. Ideally, the flow rate of fuel exiting the air assist fuel injector 50 would instantaneously decrease when the flow rate of fuel supplied to the air assist fuel injector decreases. However, as described above, liquid fuel tends to accumulate in the area between the cap 52 and the armature 54; it takes time for the air flowing through the air assist fuel injector 50 to scavenge this accumulated fuel out of the injector. At steady fueling rates, this accumulated fuel generally does not create problems. However, this accumulated fuel is delivered from the air assist fuel injector when changing fueling rates and thus adversely affects the amount of delivered fuel when the operator lets off the throttle. This effect essentially delays the response time between the different fueling rates, and decreases the reliability and overall performance of the conventional air assist fuel injector 50.

A further problem associated with other conventional air assist fuel injectors concerns the amount of time it takes the poppet to close, i.e., abut the seat, after the solenoid has been de-energized at high fueling levels. This problem is thought to be caused by surface adhesion and hydraulic delay due to pressure differentials. When increasing the fueling rate supplied to such conventional air assist fuel injectors, the pressure in the volume between the armature and the leg may have a lower pressure than volumes upstream of the armature and downstream of the leg because the pressure is not easily relieved past the bearing for the armature. This pressure differential is most prevalent in the spring pocket when the armature abuts the leg during increasing fueling rates. Because the pressure in the volume between the armature and the leg is not equal with the pressure of volumes upstream of the armature or downstream of the leg at high fueling rates, the spring must overcome a pressure differential that tends to keep the armature in its actuated position and thus keeps the poppet open when the solenoid is de-energized. This effect erratically delays the closure of the poppet at high fueling rates and is termed "hydraulic delay." Surface adhesion, i.e., "stiction" between the abutting armature and leg also contributes to this erratic closing behavior.

Hence, besides suffering from poor transient response time between different fueling rates, conventional air assist fuel injectors also suffer from erratic closing behavior due to hydraulic delay and surface adhesion at high fueling levels, which further decreases the reliability and performance of conventional air assist fuel injectors.

SUMMARY

In light of the previously described problems associated with conventional air assist fuel injectors, one object of one embodiment of the present invention is to decrease the likelihood that fuel will accumulate in the air assist fuel injector and adversely affect transient response times between different fueling levels. A further object of one embodiment of the present invention is to decrease the likelihood that the air assist fuel injector will close erratically due to hydraulic delay and/or stiction.

Other objects, advantages and features associated with the embodiments of the present invention will become more readily apparent to those skilled in the art from the following detailed description. As will be realized, the invention is capable of other and different embodiments, and its several details are capable of modification in various obvious aspects, all without departing from the invention. Accordingly, the drawings and the description are to be regarded as illustrative in nature, and not limitative.

DETAILED DESCRIPTION OF THE PREFERRED EMBODIMENTS

Figure 2:
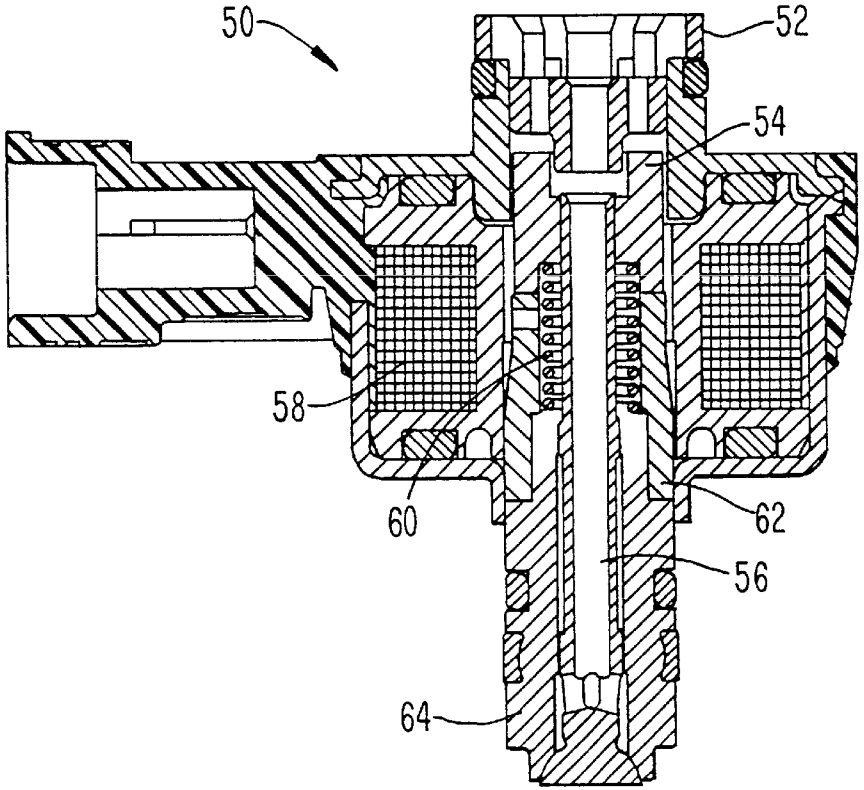
FIG. 2 PRIOR ART
FIG. 2 is a cross-sectional view of the air assist fuel injector illustrated in FIG. 1 taken along the line 2—2 in FIG. 1.
Figure 1:
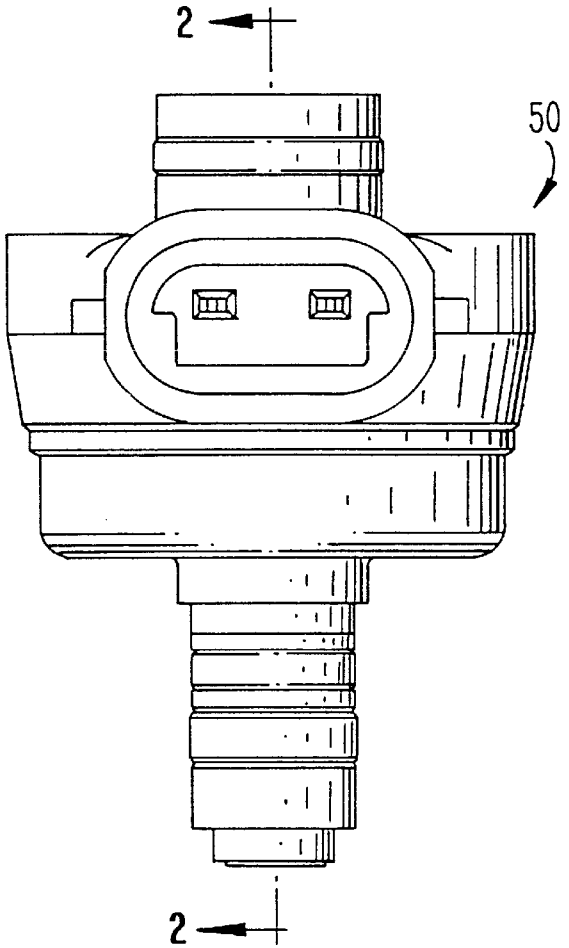
FIG. 1 PRIOR ART
FIG. 1 is a side view of a conventional air assist fuel injector.
Figure 5:
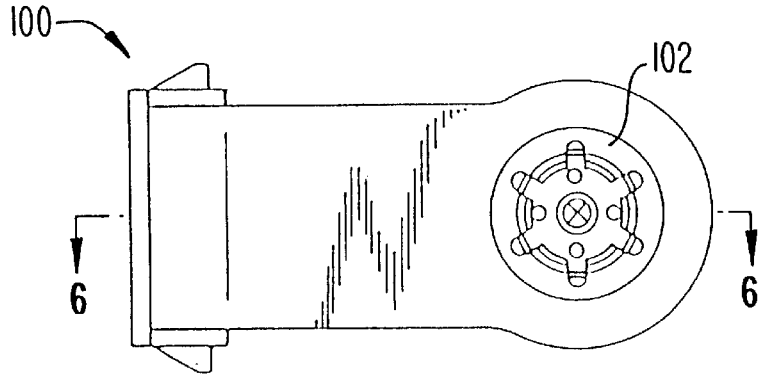
FIG. 5 is a top view of the air assist fuel injector illustrated in FIG. 3.
Figure 3:
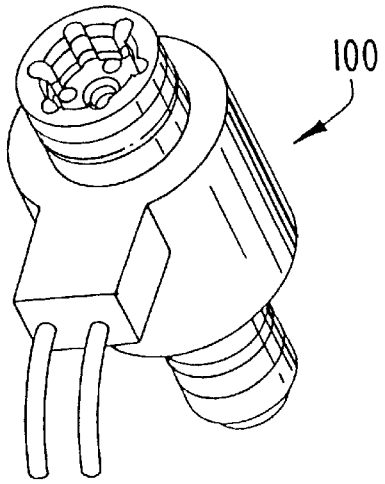
FIG. 3 is a perspective view of an air assist fuel injector according to one embodiment of the present invention.
Figure 4:
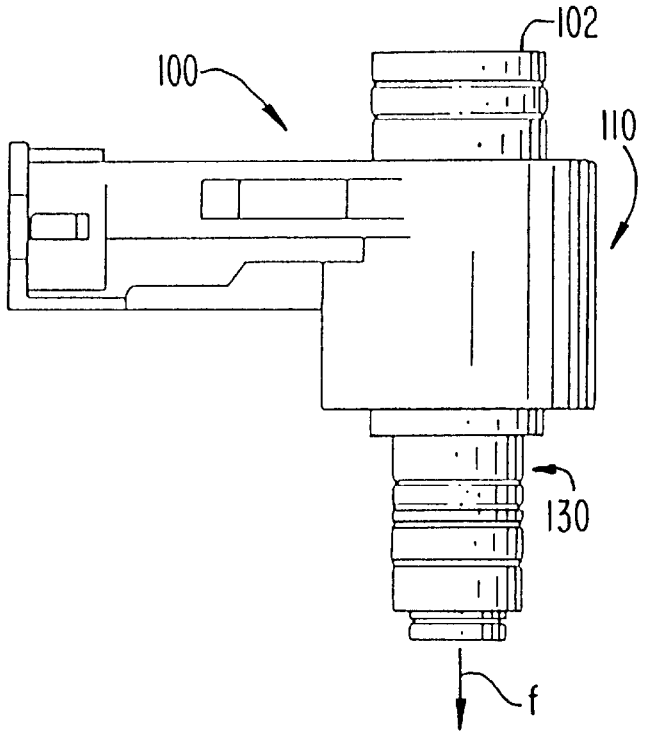
FIG. 4 is a side view of the air assist fuel injector illustrated in FIG. 3.
Figure 6:
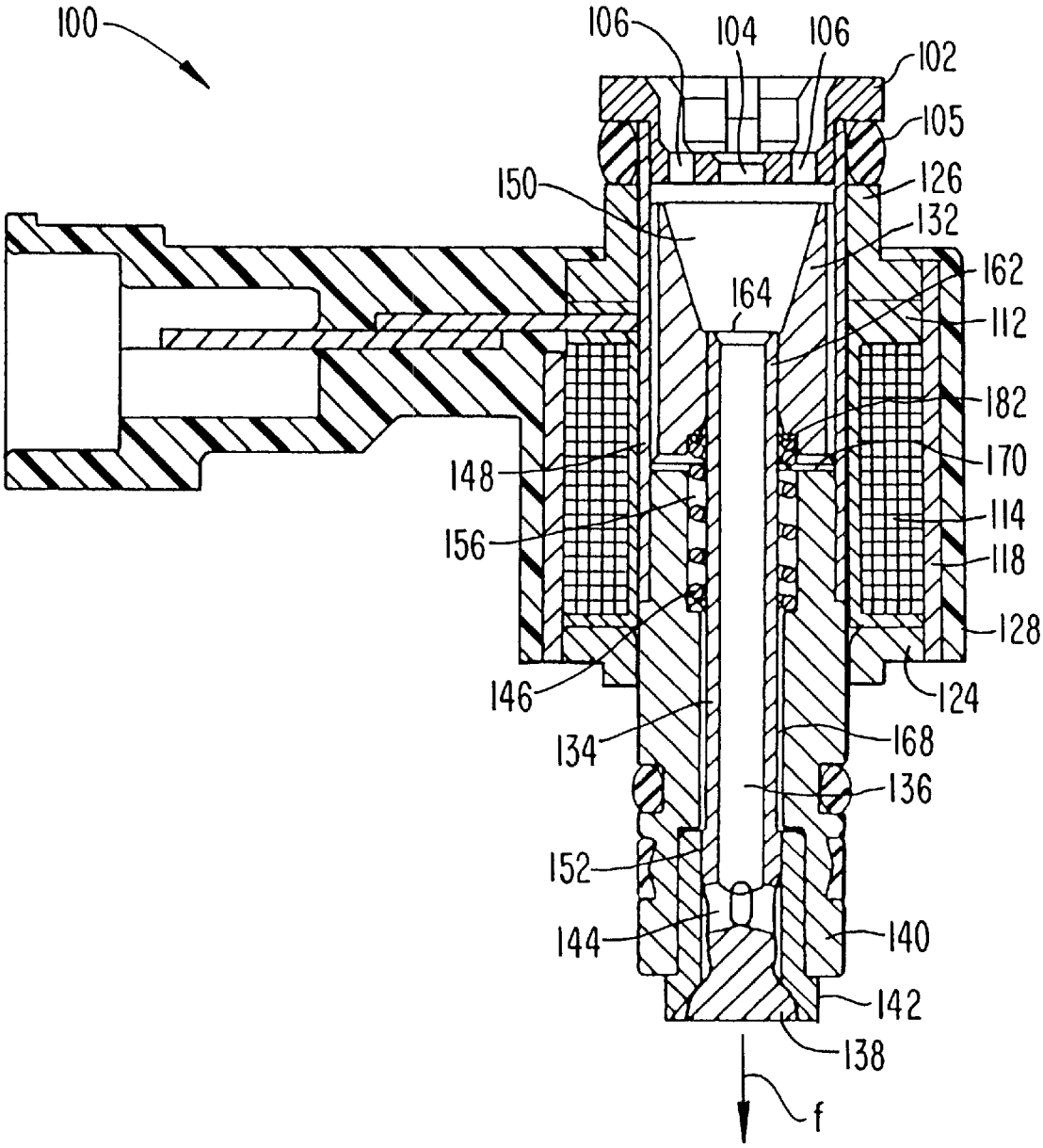
FIG. 6 is a cross-sectional view of the air assist fuel injector illustrated in FIG. 3 taken along the line 6—6 in FIG. 5.
Figure 7:
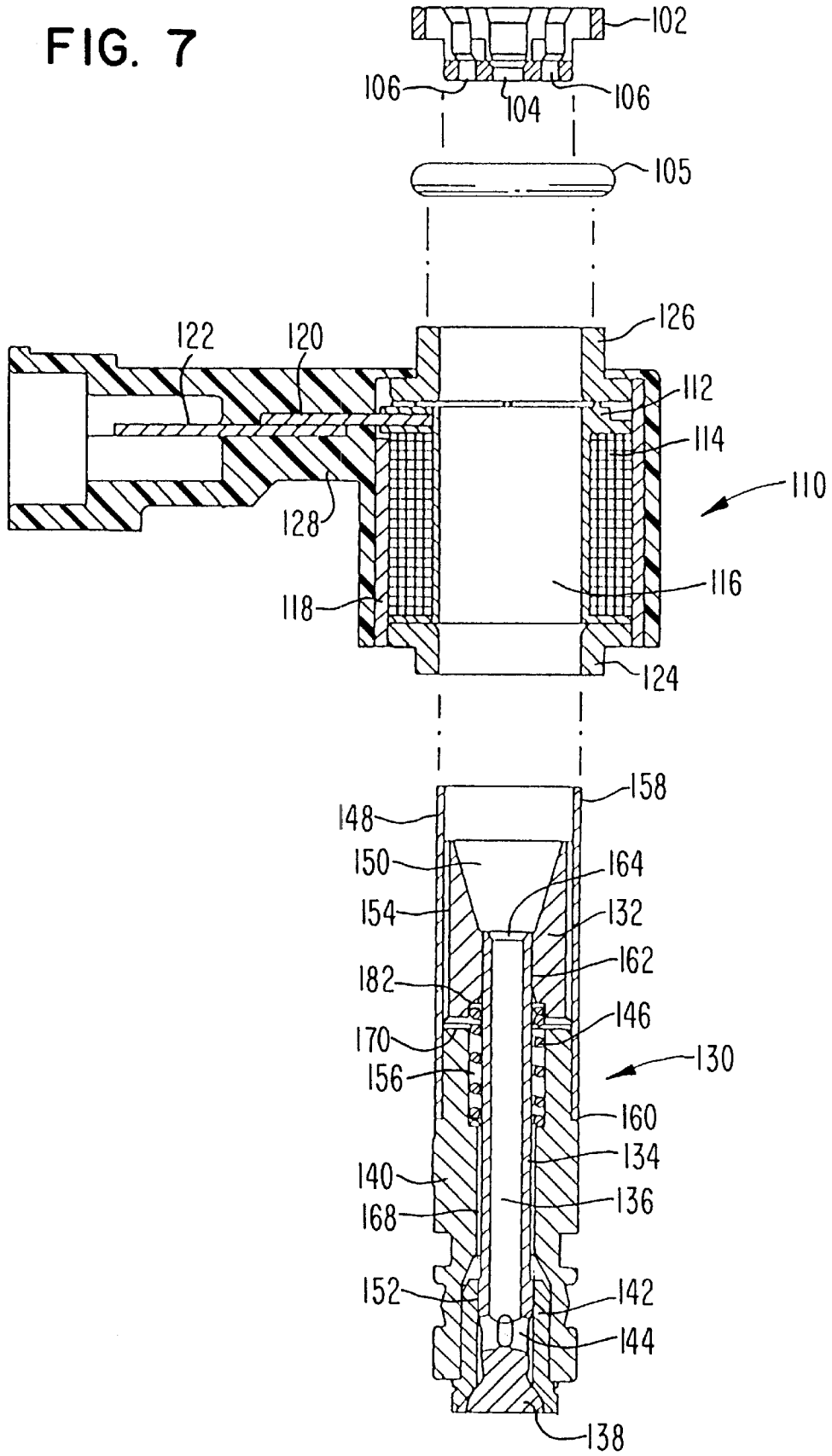
FIG. 7 is an exploded view of FIG. 6.

FIGS. 3–13 illustrate an air assist fuel injector 100 in accordance with one embodiment of the present invention. The air assist fuel injector 100 is configured to utilize pressurized gas to atomize low pressure liquid fuel, which together travel through the air assist fuel injector 100 along a direction of flow f as indicated in FIGS. 4 and 6. As best illustrated by FIG. 7, the air assist fuel injector 100 includes two primary assemblies: a solenoid assembly 110 and a valve assembly 130.

The solenoid assembly 110 at least includes a coil 114 of conductive wire wrapped around a tubular bobbin 112. The coil 114 preferably includes a winding of insulated conductor that is wound helically around the bobbin 112. The coil 114 has two ends that are electrically connected, such as soldered, to a terminal 120. The coil 114 is energized by providing current to connectors 122, which are electrically connected to the terminals 120.

The bobbin 112 of the solenoid assembly 110 is essentially a spool on which the conductor of the coil 114 is wound. The bobbin 112 defines a throughhole 116 in which an armature 132 is electromagnetically actuated, as further described below. The bobbin 112 and the coil 114 are located at least partially within a tubular casing 118 of ferromagnetic material. Hence, the tubular casing 118 at least partially encases the coil 114. The solenoid assembly 110 also includes an upper retainer 126 and a lower retainer 124, which are annular bodies that partially close off the end of the casing 118. The upper retainer 126 and the lower retainer 124 include a cylindrical passageway coincident with the throughhole 116 of the bobbin 112. The retainers 126, 124 of the solenoid assembly 110 retain the bobbin 112 and coil 114 in the casing 118. The cylindrical passageway of the upper retainer 126 receives at least a portion of a cap 102, which is further described below. The cylindrical passageway of the lower retainer 124 receives at least a portion of the valve assembly 130. The solenoid assembly 110 also includes an overmold 128 of insulative material, such as glass-filled nylon, that houses the casing 118 and at least a portion of the upper and lower retainers 126, 124. The overmold 128 also houses the terminals 120 and a portion of the connectors 122.

Although the preferred embodiment of the solenoid assembly 110 includes the items illustrated in FIG. 7, it will be appreciated that alternative embodiments of the solenoid assembly 110 may include more or less of these items, so long as the solenoid assembly includes the coil 114 and bobbin 112 such that it is capable of actuating the armature 132 when energized. For example, another embodiment of the solenoid assembly 110 may only include the coil 114, the bobbin 112, and the casing 118.

Referring again to FIG. 7, the valve assembly 130 of the air assist fuel injector 100 defines the dynamic portion of the air assist fuel injector 100 that functions as a valve to deliver the atomized quantity of liquid fuel and gas. In the preferred embodiment, the valve assembly 130 includes the armature 132, a poppet 134, a seat 142, a leg 140, a spring 146, and an armature guide 148. The armature 132 is formed of a ferromagnetic material, such as 430 FR stainless steel or similar, and functions as the moving part of an electromagnetic actuator, defined by the solenoid assembly 110 and armature 132 combination. As illustrated in FIG. 6, the armature 132 of the air assist fuel injector 100 is located relative to the solenoid assembly 110 such that the armature is subject to the lines of flux generated by the solenoid assembly 110. Hence, the armature 132 is actuated when the solenoid assembly 110 is energized. In the preferred embodiment, the armature 132 is located partially within the throughhole 116 of the bobbin 112. The armature 132 includes a conduit 150 that conveys a mixture of liquid fuel and gas to an inlet 164 of the poppet 134.

The poppet 134 is attached to the armature 132, which is actuated by energizing the solenoid assembly 110. As illustrated in FIGS. 6 and 7, in the preferred embodiment, a portion of the conduit 150 receives an end portion 162 of the poppet 134. Hence, the inlet 164 of the poppet is located immediately downstream of at least a portion of the conduit 150 with respect to the direction of flow f of the mixture of liquid fuel and gas. In the preferred embodiment, the end portion 162 of the poppet 134 is attached to the armature 132 with a welded connection, preferably a YAG laser weld. However, alternative embodiments are also contemplated. For example, the poppet 134 may be attached to the armature 132 at any variety of locations with an interference fit, an adhesive, a threaded or screwed attachment, a lock and key attachment, a retaining ring attachment, an electron beam weld, an ultrasonic weld, or other known attachments. Because the poppet 134 is attached to the armature, the poppet 134 will move with the armature 132 when the armature is actuated by energizing the solenoid assembly 110.

Figure 12:
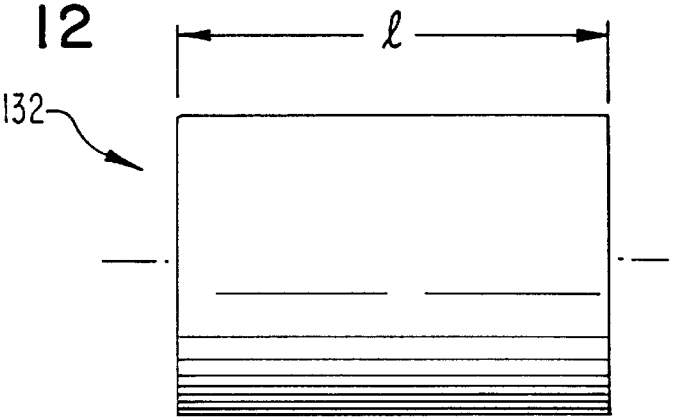
FIG. 12 illustrates a side view of the armature illustrated in FIG. 10.
Figure 11:
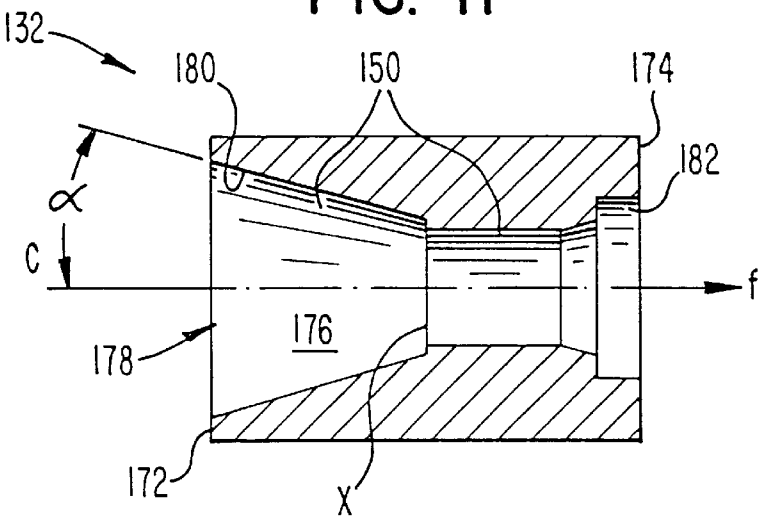
FIG. 11 illustrates a cross-sectional view of the armature illustrated in FIG. 10 taken along the line 11—11 in FIG. 10.
Figure 10:
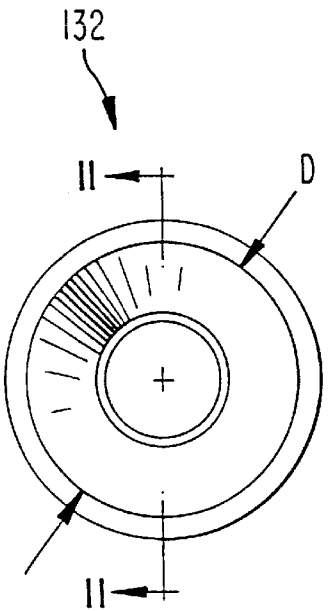
FIG. 10 illustrates an end view of the armature of the air assist fuel injector illustrated in FIG. 3.

FIGS. 10–12 illustrate in further detail the armature 132 of the air assist fuel injector 100. At least a portion of the conduit 150 of the armature 132 conveys the mixture of liquid fuel and gas to the inlet 164 of the poppet 134. The conduit 150 is a pipe or channel and includes a circular inlet 178. In alternative embodiments, the inlet 178 may take other shapes, such as oval shapes, rectangular shapes, or random shapes. The conduit 150 extends from a first, upstream end 172 of the armature 132 to a second, downstream end 174 of the armature 132 located opposite from the first end 172. Although preferred that the ends 172, 174 are planar, it will be appreciated that the ends 172, 174 may take other shapes. For example, the ends 172, 174 may include a radius or ridges and may be beveled. To help prevent surface adhesion between the armature 132 and a stop surface 170 of the leg 140 when the armature is actuated, the second end 174 of the armature and/or the stop surface 170 possess a surface texture roughness index number between 1–4, preferably a surface texture roughness index number near 3.2.

As illustrated in FIGS. 6, 7, 10 and 11, the conduit 150 includes a conical portion 176. The conical portion 176 is a cone shaped conduit whose cross-sectional area (as measured in a plane transverse to a center axis C) decreases in the direction of flow f. In the preferred embodiment of the armature 132, the conical portion 176 includes a surface 180 at an angle $\alpha$ of 16°, as measured from the center axis C of the conduit 150. In other embodiments of the armature 132, the angle $\alpha$ may be between 10–45°, but is preferably between 10–35°, and more preferably between 15 25°. Additionally, the angle $\alpha$ may continuously change along the length of the conical portion 176 to define a curved conical portion, similar to a curved funnel.

In the preferred embodiment of the air assist fuel injector 100, the conical portion 176 extends from the first end 172 to a location x, which is at an approximate midpoint along the length l of the armature 132. As illustrated in FIGS. 6 and 7, a portion of the conduit 150 preferably receives the end portion 162 of the poppet 134 to such an extent that the inlet 164 is located near the location x or downstream of location x with respect to the direction of flow f of the mixture of liquid fuel and gas. That is, it is preferable that the inlet 164 of the poppet 134 be located near the termination point of the conical portion 176 or at another location downstream of the conical portion 176. In alternative embodiments of the air assist fuel injector 100, the inlet 164 may be located upstream or downstream of the location x where the conical portion 176 terminates, depending upon the location where the poppet 134 is attached to the armature 132. For example, the end portion 162 of the poppet may be attached to the second end 174 of the armature such that the inlet 164 is directly adjacent the second end 174. Additionally, the conical portion 176 of the conduit 150 may extend further downstream of the armature 132 than the embodiment illustrated in FIG. 15. For example, the conical portion 176 may extend ¼ of the total length l of the armature 132 or may extend the entire length l of the armature, as will be apparent.

The poppet 134 is an elongated hollow tube for conveying the mixture of liquid fuel and pressurized gas, and includes a stem and a head 138. The inlet 164 of the poppet 134 opens into a tubular passageway 136, which extends from the inlet 164 to the outlets 144, which are located just prior to the head 138 of the poppet. In the preferred embodiment, the poppet 134 includes four slot-shaped outlets 144 that are equally spaced from each other and located approximately transverse to the longitudinal axis of the poppet. Although preferred that the poppet 134 have four slot-shaped outlets 144, other configurations will suffice. For example, the poppet 134 may include one slot-shaped out, two circular outlets, five oval outlets or ten pin sized outlets.

The head 138 of the poppet 134 is located downstream of the outlets 144 with respect to the direction of flow f and is roughly mushroomed shaped with a curved or angled face that abuts the seat 142 when the solenoid assembly 110 is not energized. When the armature 132 is actuated by energizing the solenoid assembly 110, the poppet 134 moves with the armature 132 such that the head 138 lifts off of the seat 142 in a direction away from the air assist fuel injector 100. When the head 138 is lifted off the seat 142, a seal is broken between the head 138 and seat 142 such that liquid fuel and gas exiting the outlets 144 exits the air assist fuel injector 100.

As is also illustrated in FIGS. 6 and 7, movement of the poppet 134 is guided at a bearing 152 located between the poppet 134 and seat 142. The bearing 152 is located just prior to the outlets 144 with respect to the direction of flow f of the liquid fuel and gas through the air assist fuel injector 100. Hence, the poppet 134 and seat 142 include a bearing surface for guiding movement of the poppet near the head end of the poppet. Because the seat 142 serves as a bearing for poppet movement and also absorbs the impact of the head 138 when the poppet valve assembly 130 opens and closes, the seat is preferably fabricated from a wear and impact resistant material, such as hardened 440 stainless steel. It will be appreciated that the air assist fuel injector 100 need not include a separate seat 142. For example, the leg 140 may define the seat 142 and bearing 152.

As further illustrated in FIGS. 6 and 7, the poppet 134 moves within an elongated channel 168 of the leg 140. The leg 140 is an elongated body through which the poppet 134 moves and which supports the seat 142. The channel 168 of the leg 140 through which the poppet 134 moves may also serve as a secondary flow path for the pressurized gas. Hence, when the head 138 lifts off the seat 142, pressurized gas flows outside the poppet 134 but inside the leg 140 to help atomize the liquid fuel and gas exiting the outlets 144.

The spring 146 of the valve assembly 110 is located between the armature 132 and leg 140. More particularly, the spring 146 sits within a bore 156 that is concentric with the elongated channel 168 of the leg 140. The bore 156 faces the armature 132 and defines a seat for the spring 146. The spring 146 is a compression spring having a first end that abuts the armature 132 and a second end that abuts the leg 140. The bottom of the bore 156 defines the seat for the downstream end of the spring 146 and a recess 182 in the armature 132 defines a seat for the upstream end of the spring. When the solenoid assembly 110 is not energized the spring 146 biases the armature 132 away from the leg 140, and thus the poppet 134 is maintained in a closed position where the head 138 abuts the seat 142. However, when the solenoid assembly 110 is energized, the electromagnetic force causes the armature 132 to overcome the biasing force of the spring 146, such that the armature moves toward the leg 140 until it abuts a stop surface 170 of the leg 140. When the solenoid assembly 110 is de-energized, the electromagnetic force is removed and the spring 146 again forces the armature 132 away from the stop surface 170 until the poppet head 138 abuts the seat 142.

As is also illustrated in FIGS. 6 and 7, movement of the armature 132 is guided by a bearing 154 between the outer surface of the armature 132 and the inner surface of the armature guide 148. The armature guide 148 is essentially a tube that extends at least a portion of the length of the armature 132 to act as a guide for the armature. In the preferred embodiment, the armature guide 148 has a first end 158 located upstream of the armature 132 with respect to the direction of flow f and a second end 160 located downstream of the armature with respect to the direction of flow f such that the armature guide 148 also seals the solenoid assembly 110 from the liquid fuel and gas flowing through the valve assembly 130. Hence, the second end 160 of the armature guide 148 is sealingly attached to the leg 140 such as by a laser weld or otherwise, and the outer surface of the armature guide 148 near the first end 158 serves as a sealing surface for an upper seal 105. This arrangement helps prevent any liquid fuel and gas from exiting the air assist fuel injector 100. Although the armature guide 148 is preferred, it will be appreciated that the air assist fuel injector 100 need not include the armature guide 148. For example, a portion of the solenoid assembly 110 or a separate insert may function as a guide for the armature 132. Additionally, the solenoid assembly 110 may be sealed from the liquid fuel and gas with multiple O-rings rather than with the aid of the armature guide 148, as will be apparent.

Figure 13:
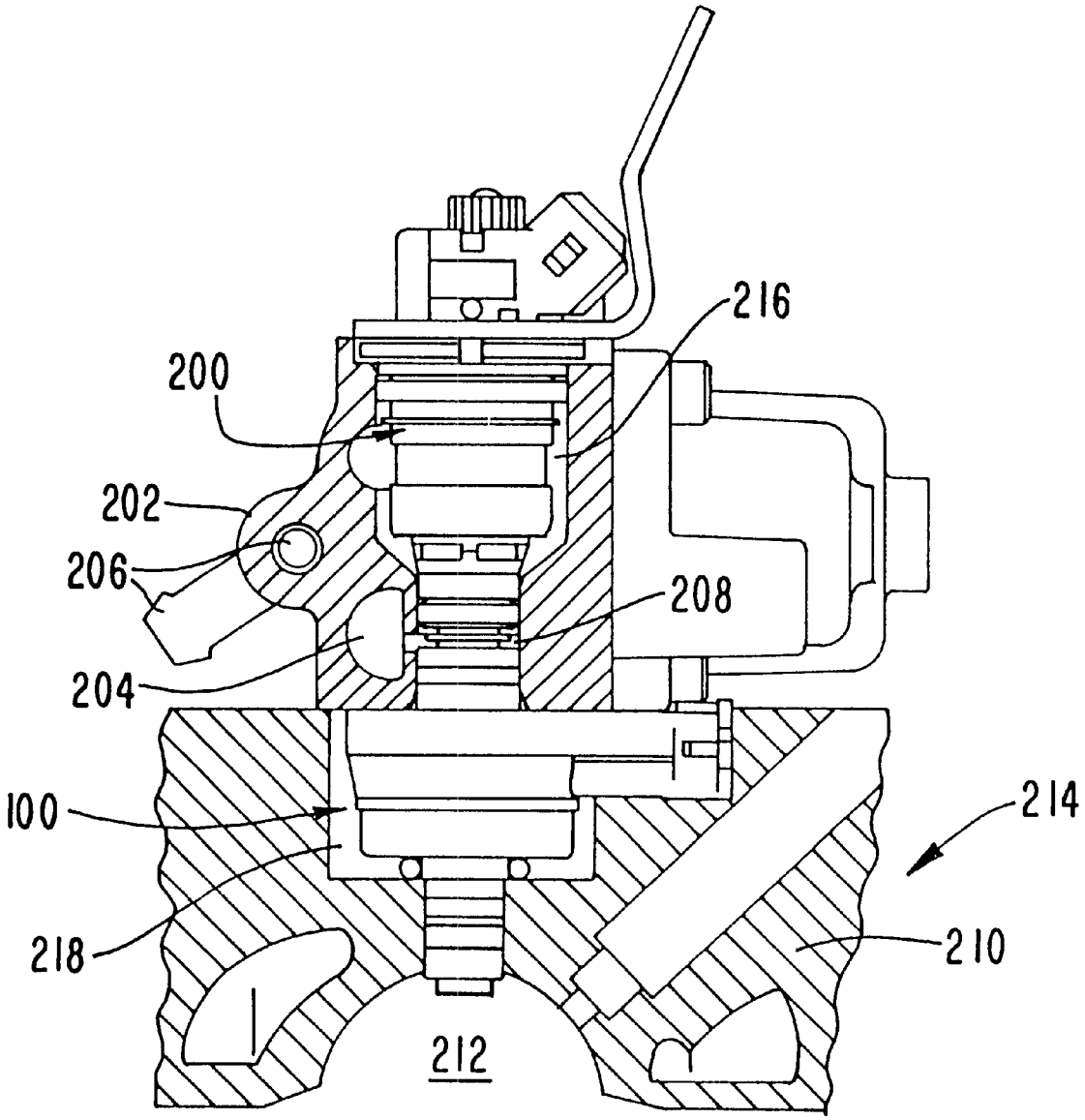
FIG. 13 is a partial cross-sectional view of the air assist fuel injector illustrated in FIG. 3 located in the head of a two stroke internal combustion engine.

The air assist fuel injector 100 utilizes pressurized air to atomize low pressure fuel. When installed in an engine, the air assist fuel injector 100 is located such that the atomized low pressure fuel that exits the air assist fuel injector is delivered to the internal combustion chamber of an engine, i.e., the part of an engine in which combustion takes place, normally the volume of the cylinder between the piston crown and the slender head, although the combustion chamber may extend to a separate cell or cavity outside this volume. For example, as illustrated by FIG. 13, the air assist fuel injector 100 is located in a cavity 218 of a two stroke internal combustion engine head 210 such that the air assist fuel injector 100 can deliver a metered quantity of atomized liquid fuel to a combustion cylinder 212 of a two stroke internal combustion engine 214, where it is ignited by a spark plug or otherwise. As is illustrated by FIG. 13, the air assist fuel injector 100 is located adjacent a conventional fuel injector 200. The fuel injector 200 is located at least partially in a cavity 216 of an air/fuel rail 202 configured for the two stroke engine 214. Examples of fuel injectors that are suitable for delivering liquid fuel to the air assist fuel injector 100 include any top or bottom feed manifold port injector, commercially available from Bosch, Siemens, Delphi, Nippondenso, Keihen, Sagem, or Magneti Morelli. The air/fuel rail 200 includes one or more internal passageways and/or lines 206 that deliver liquid fuel to the fuel injector 200, as well as one or more passageways 204 that deliver pressurized gas, preferably air, to the air assist fuel injector 100.

The air assist fuel injector 100 is termed "air assist" fuel injector because it preferably utilizes pressurized air to atomize liquid fuel. In the preferred embodiment, the pressure of the air is at roughly 550 KPa for two stroke applications and at roughly 650 KPa for four stroke applications. The pressure of the liquid fuel is preferably higher than that of the air pressure and is roughly between 620–800 KPa. In other applications, the air pressure is between 1000–1500 KPa. Although it is preferred that the air assist fuel injector 100 atomize liquid gasoline with pressurized air delivered by the air/fuel rail 202, it will be realized that the air assist fuel injector 100 may atomize many other liquid combustible forms of energy with any variety of gases. For example, the air assist fuel injector 100 may atomize liquid kerosene or liquid methane with pressurized gaseous oxygen, propane, or exhaust gas. Hence the term "air assist" is a term of art, and as used herein is not intended to dictate that the air assist fuel injector 100 be used only with pressurized air.

As illustrated in FIG. 13, the air/fuel rail 202 also defines a mount for the air assist fuel injector 100. That is, the air/fuel rail 202 abuts against at least one surface of the air assist fuel injector 100 to retain the air assist fuel injector in place in the cavity 218 of the head 210. In an alternative embodiment not illustrated, an o-ring defines a seal between the air assist fuel injector and the air/fuel rail. Such an o-ring may be considered part of the air assist fuel injector 100 or the air/fuel rail 202.

Figure 8:
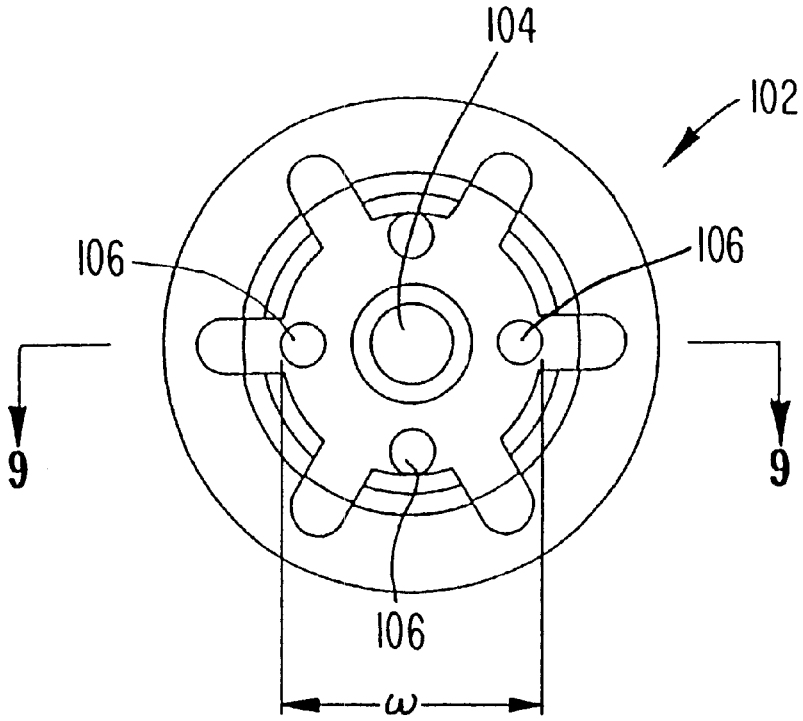
FIG. 8 is a top view of the cap of the air assist fuel injector illustrated in FIG. 3.
Figure 9:
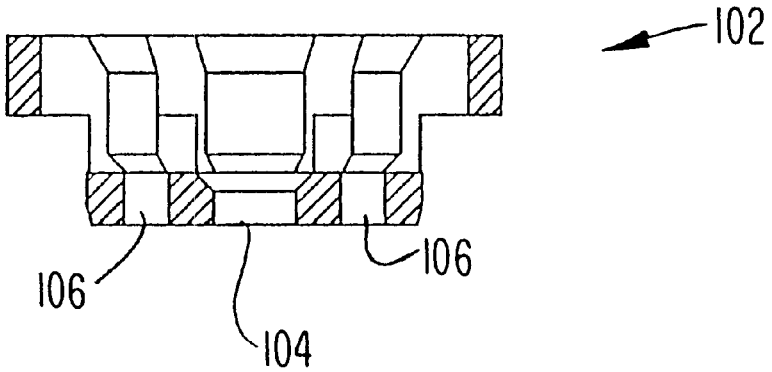
FIG. 9 is a cross-sectional view of the cap illustrated in FIG. 8 taken along the line 9—9 in FIG. 8.

The conventional fuel injector 200 is configured and located such that it delivers a metered quantity of liquid fuel directly to the inlet of the cap 102 of the air assist fuel injector 100. Hence, the cap 102 receives the pressurized gas from the air/fuel rail 202 as well as the liquid fuel from the conventional fuel injector 200. As illustrated in FIGS. 8 and 9, the cap 102 includes at least one fuel passageway 104 that receives liquid fuel and at least one gas passageway 106 that receives pressurized gas. In the preferred embodiment of the air assist fuel injectors 100, the cap 102 includes only one cylindrical liquid fuel passageway 104 located along the center axis of the cap, and four cylindrical gas passageways 106 circumferentially and equally spaced about the liquid fuel passageway 104. In alternative embodiments, the air assist fuel injectors 100 does not include the cap 102 or includes an alternatively configured cap. For example, the liquid fuel and pressurized gas may enter the air assist fuel injector 100 through the armature 132 of the air assist fuel injector, as opposed to the cap 102 . Alternatively, the cap 102 may include only one passageway that receives liquid fuel and pressurized gas for eventual or immediate delivery to the interior of the air assist fuel injectors 100. Because of the proximity of the outlet of the fuel injector 200 with respect to the cap 102, the majority of the liquid fuel exiting from the fuel injector will enter the fuel passageway 104. The pressurized gas is delivered to the cap 102 via an annular passageway 208 in the air/fuel rail 202. The majority of the pressurized gas conveyed by the air/fuel rail 202 will thus enter the gas passageways 106 of the cap 102. Hence, the cap 102 functions as an inlet to the air assist fuel injector 100 for the pressurized gas and liquid fuel.

The pressurized gas and the liquid fuel mixture exits the cap 102 and then enters the armature 132 located downstream of the cap with respect to the direction of flow f. The liquid fuel and pressurized gas mix in the conical portion 176 of the conduit 150 and are conveyed to the inlet 164 of the poppet 134. Thereafter, the liquid fuel and gas travel through the tubular passageway 136 of the poppet 134. When the solenoid assembly 110 is energized, the armature 132 overcomes the biasing force of the spring 146 and moves toward the leg 140 until it sits against the stop surface 170. Because the poppet 134 is attached to the armature 132, the head 138 of the poppet lifts off of the seat 142 in the direction of flow f when the armature 132 is actuated. When the head 138 lifts off of the seat 142, a seal between the head 138 and the seat 142 is broken and the gas and fuel mixture exit the outlets 144. The mixture exiting the outlets 144 is then forced out of the air assist fuel injector 100 over the head 138 so that a metered quantity of atomized liquid fuel is delivered to the combustion chamber 212 of the engine 214.

When the previously described solenoid assembly 110 is de-energized, the biasing force of the spring 146 returns the armature 132 to its original position. Because the poppet 134 is attached to the armature 132, the head 138 of the poppet 134 returns to the seat 142 to define a seal that prevents further gas and fuel from exiting the air assist fuel injector 100. Hence, the air assist fuel injector 100 atomizes the liquid fuel supplied by the conventional fuel injector 200 with the pressurized gas supplied via the air/fuel rail 202. The atomized fuel is then delivered to the combustion chamber 212 of the engine 214 where it is ignited to power the engine.

As described above, the liquid fuel and gas exiting the cap 102 mix in the conical portion 176 of the armature conduit 150. The conical shape of the conical portion 176 serves to funnel the liquid fuel and gas into and down the passageway 136 of the poppet 134. This helps prevent the accumulation of any liquid fuel in the area between the cap 102 and the armature 132 that may adversely affect the transient response time between different fueling rates.

Additionally, the conical design of the armature 132 decreases the weight of the armature 132 as compared with conventional armatures configured for similar applications, which beneficially decreases the level of noise generated when the armature abuts the stop surface 170. Because the cross-sectional area of the conical portion 176 decreases in the direction of flow f within the armature 132, more ferromagnetic material exists near the second end 174 of the armature to allow for increased flux density from the solenoid assembly 110. Hence, the armature 132 is easily actuated, but is advantageously capable of delivering a larger quantity of air and liquid fuel each cycle of the air assist fuel injector 100 than some conventional air assist fuel injectors.

Furthermore, as is illustrated in FIGS. 5, 6 and 10, the inlet 178 of the armature 132 is circular, having a diameter D. As illustrated in FIGS. 8 and 9, the distance o between the outermost point of opposing gas passageways 106 is less than the diameter D of the inlet 178. Thus, the gas passageways 106 and the fuel passageways 104 of the cap 102 are located radially inward of the periphery of the inlet 178, which assists delivery of the liquid fuel and gas directly into the conduit 150 and passageway 136 of the poppet 134. This configuration tends to prevent the accumulation of any liquid fuel in the area between the cap 102 and the armature 132 that may adversely affect the transient response time between different fueling rates.

FIGS. 14–48 illustrate alternative embodiments of air assist fuel injectors 200, 300, 400, 500, 600, 700, 800, 900, 1110 according to the present invention. The foregoing discussion of the features, functions, and benefits of the air assist fuel injector 100 also applies to the air assist fuel injectors 200, 400, 500, 600, 700, 800, 900, 1100. Thus, the air assist fuel injectors 200, 400, 500, 600, 700, 800, 900, 1100 illustrated in FIGS. 14–48 have been assigned corresponding reference numbers as the air assist fuel injector 100, increased by hundreds. As is apparent, the air assist fuel injectors 200, 300, 400, 500, 600, 700, 800, 900, 1100 include many additional features and inherent functions, as is described further below.

Figure 14:
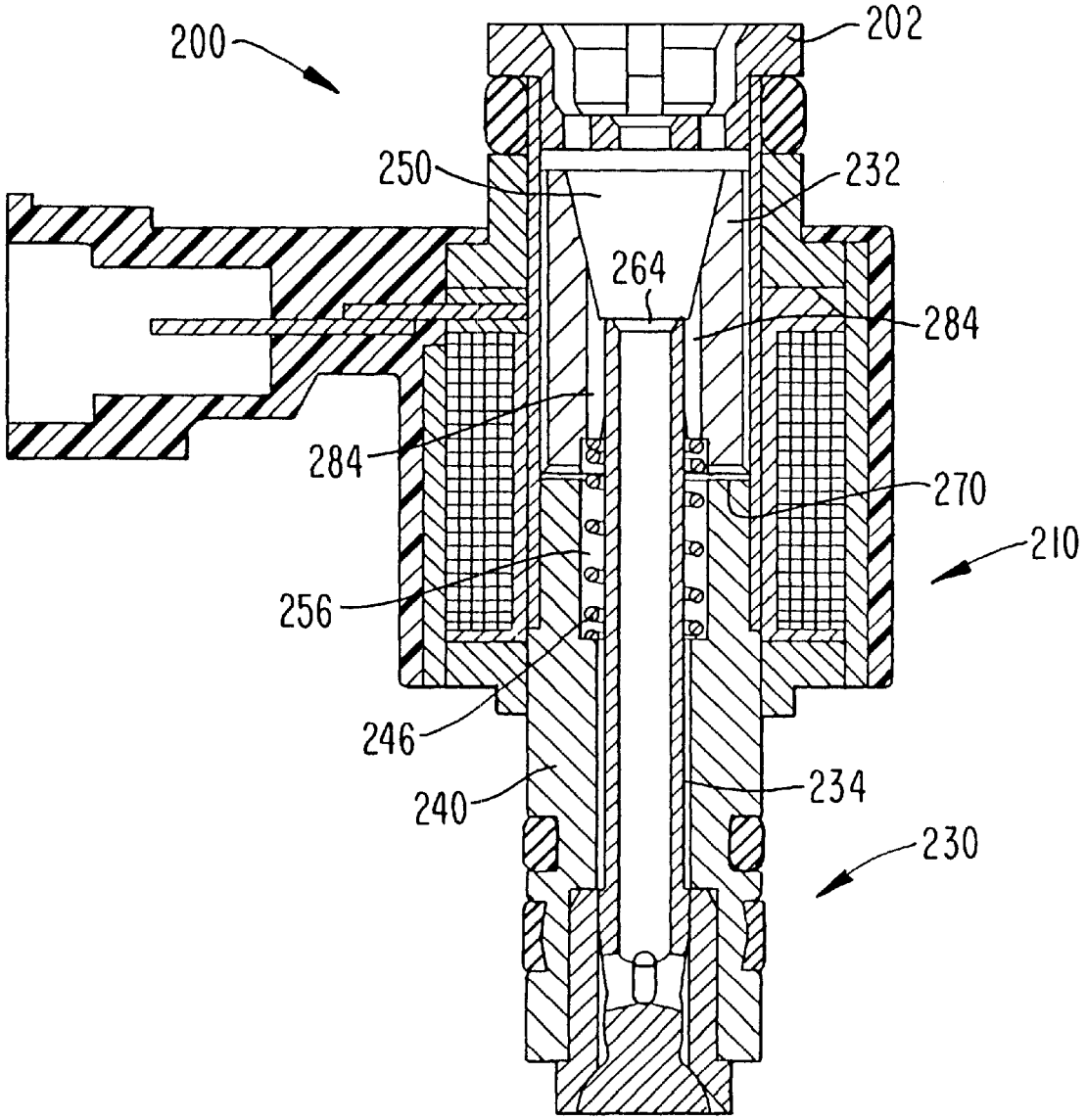
FIG. 14 illustrates an alternative embodiment of an air assist fuel injector in accordance with the present invention.
Figure 17:
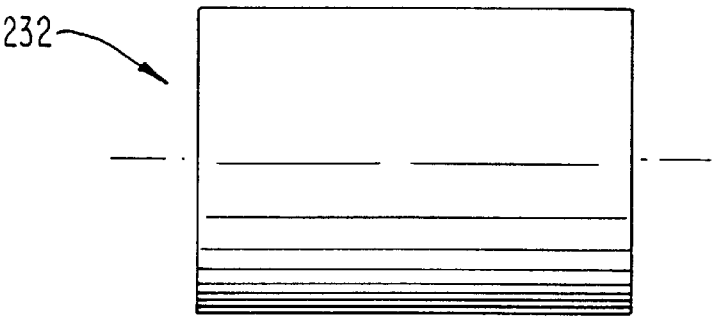
FIG. 17 illustrates a side view of the armature illustrated in FIG. 15.
Figure 16:
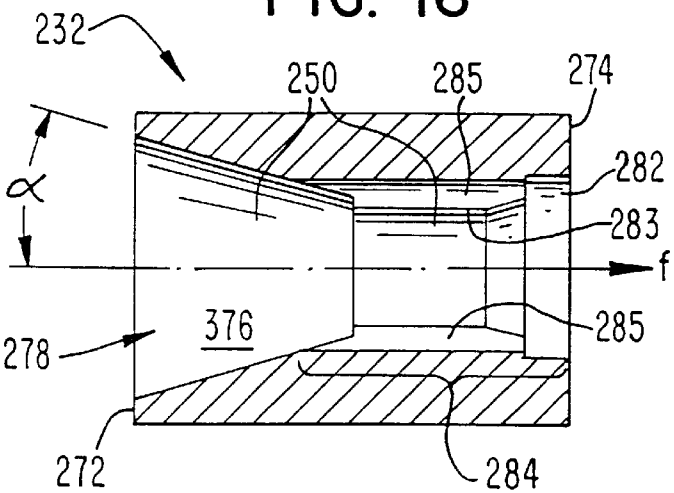
FIG. 16 illustrates a cross-sectional view of the armature illustrated in FIG. 15 taken along the line 16—16 in FIG. 15.
Figure 15:
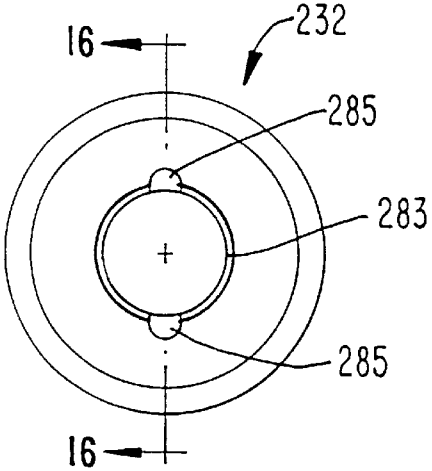
FIG. 15 illustrates an end view of the armature of the air assist fuel injector illustrated in FIG. 14.

As illustrated in FIG. 14, the air assist fuel injector 200 is identical to the air assist fuel injector 100 in all respects, except for the armature 232. As illustrated in FIGS. 15–17, the armature 232 of the air assist fuel injector 200 includes a flow path 284 that preferably extends from an area upstream of the inlet 264 of the poppet 232 to an area downstream of the armature 232 with respect to the direction of flow f. In the embodiment illustrated in the FIGS. 14–17, the flow path 284 includes a portion of the recess 282 for the spring 246 as well as two recessed linear slots 285 located in the cylindrical surface 283 of the conduit 250 that abuts the poppet 234. The slots 285 are preferably located on opposite sides of the portion of the conduit 250 that receives the upstream end of the poppet 234. The flow path 284 prevents the possibility of a pressure differential developing in the volume between the armature 232 and the leg 240, especially in the bore 256, when the armature 232 abuts the stop surface 270. That is, the flow path 284 relieves any pressure differential between the volume between the armature 232 and the leg 240 and the volumes upstream and downstream thereof during actuation of the armature 232. Hence, the flow path 284 helps prevent hydraulic delay and/or stiction, which can cause erratic closing behavior.

Figure 18:
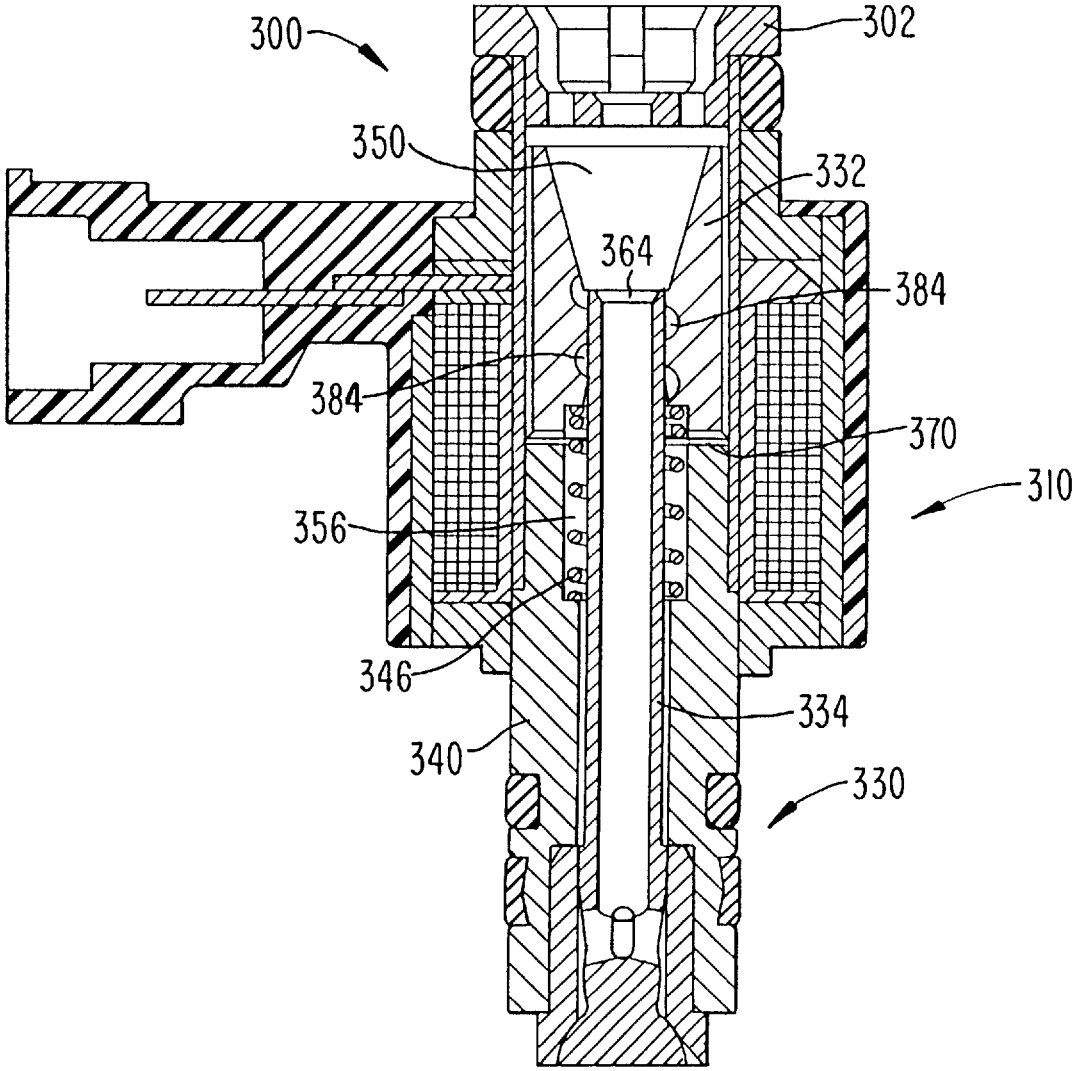
FIG. 18 illustrates an air assist fuel injector in accordance with another embodiment of the present invention.
Figure 21:
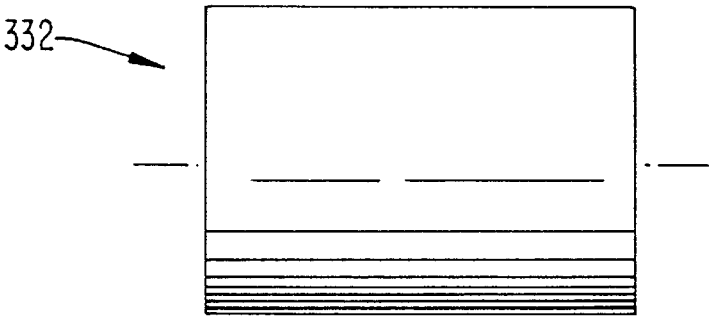
FIG. 21 illustrates a side view of the armature illustrated in FIG. 19.
Figure 20:
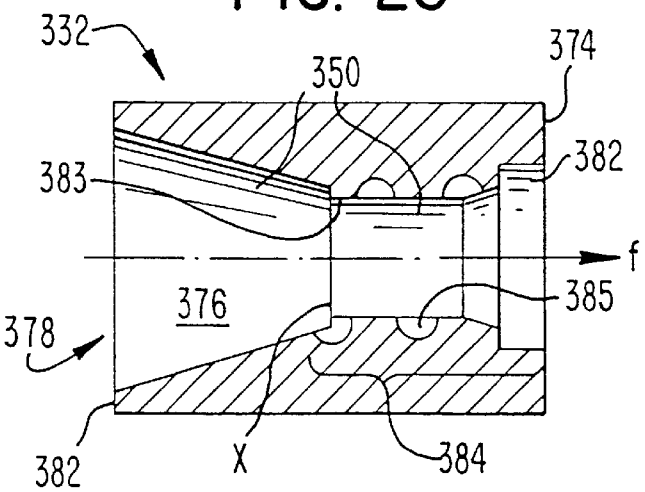
FIG. 20 illustrates a cross-sectional view of the armature illustrated in FIG. 19 taken along the line 20—20 in FIG. 19.
Figure 19:
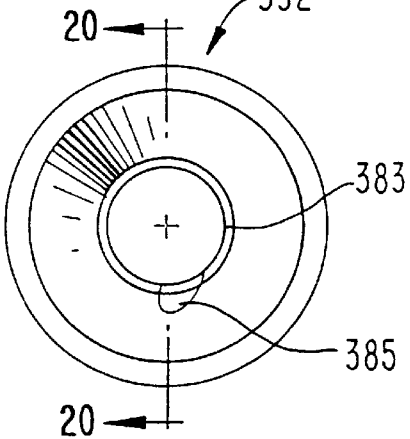
FIG. 19 illustrates an end view of the armature of the air assist fuel injector illustrated in FIG. 18.

As illustrated in FIG. 18, the air assist fuel injector 300 is identical to the air assist fuel injector 100 in all respects, except for the armature 332. As illustrated in FIGS. 18–21, the armature 332 of the air assist fuel injector 300 includes a flow path 384 that preferably extends from an area upstream of the inlet 364 of the poppet 332 to an area downstream of the armature 332 with respect to the direction of flow f. In the embodiment illustrated in the FIGS. 18–21, the flow path 384 includes a portion of the recess 382 for the spring as well as one recessed helical slot 385 located in the cylindrical surface 383 of the conduit 350 that abuts the poppet 334. The flow path 384 relieves any pressure differential between the volume between the armature 322 and the leg 340 and the volumes upstream and downstream thereof during actuation of the armature 332. Hence, the flow path 384 helps prevent hydraulic delay and/or stiction, which can cause erratic closing behavior.

Figure 22:
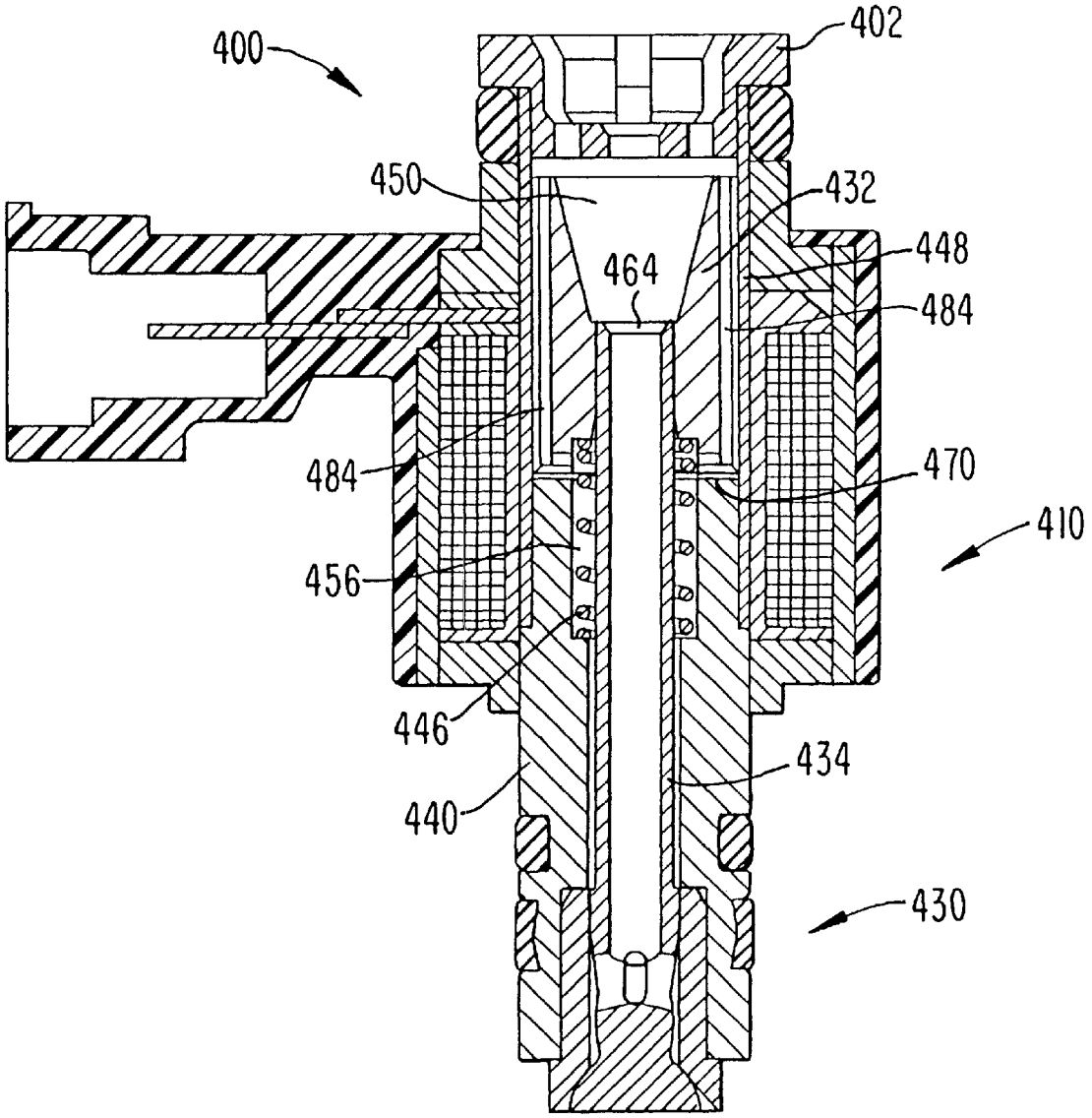
FIG. 22 illustrates a further embodiment of an air assist fuel injector in accordance with the present invention.
Figure 25:
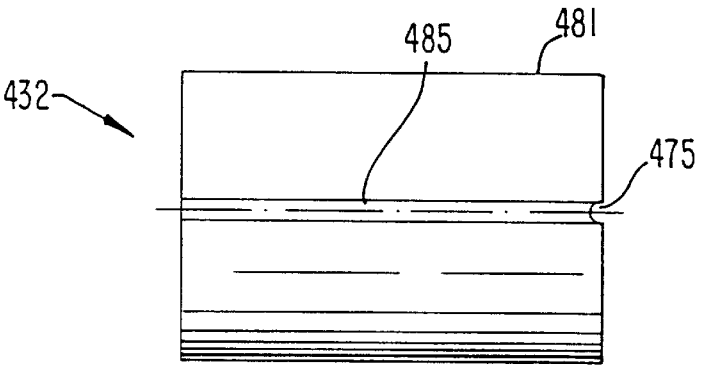
FIG. 25 illustrates a side view of the armature illustrated in FIG. 23.
Figure 24:
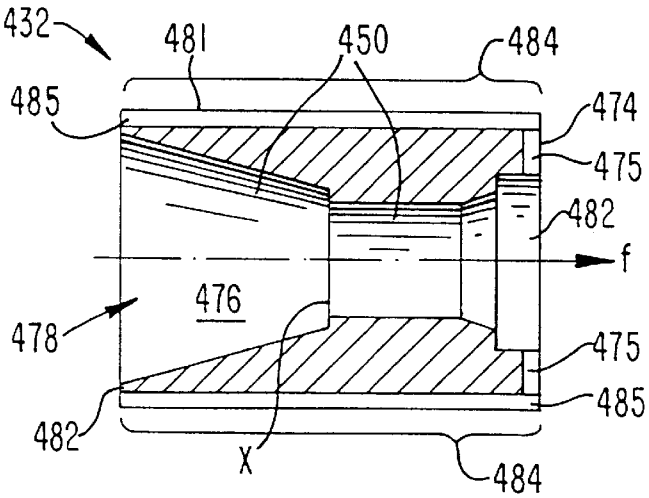
FIG. 24 illustrates a cross-sectional view of the armature illustrated in FIG. 23 taken along the line 24—24 in FIG. 23.
Figure 23:
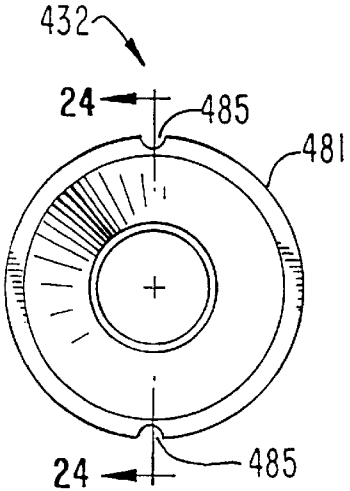
FIG. 23 illustrates an end view of the armature of the air assist fuel injector illustrated in FIG. 22.

As illustrated in FIG. 22, the air assist fuel injector 400 is identical to the air assist fuel Injector 100 in all respects, except for the armature 432. As illustrated in FIGS. 22–25, the armature 432 of the air assist fuel injector 400 includes a flow path 484 that preferably extends from an area upstream of the inlet 464 of the poppet 432, in this case the area upstream of the armature 432, to an area downstream of the armature 432 with respect to the direction of flow f. In the embodiment illustrated in FIGS. 22–25, the flow path 484 includes two recessed linear slots 485 located in the cylindrical exterior surface 481 of the armature 432 that abuts the armature guide 448, as well as two recessed linear slots 475 in the second downstream end 474. The flow path 484 relieves any pressure differential between the volume between the armature 432 and the leg 440 and the volumes upstream and downstream thereof during actuation of the armature 432. Hence, the flow path 484 helps prevent hydraulic delay and/or stiction, which can cause erratic closing behavior.

Figure 26:
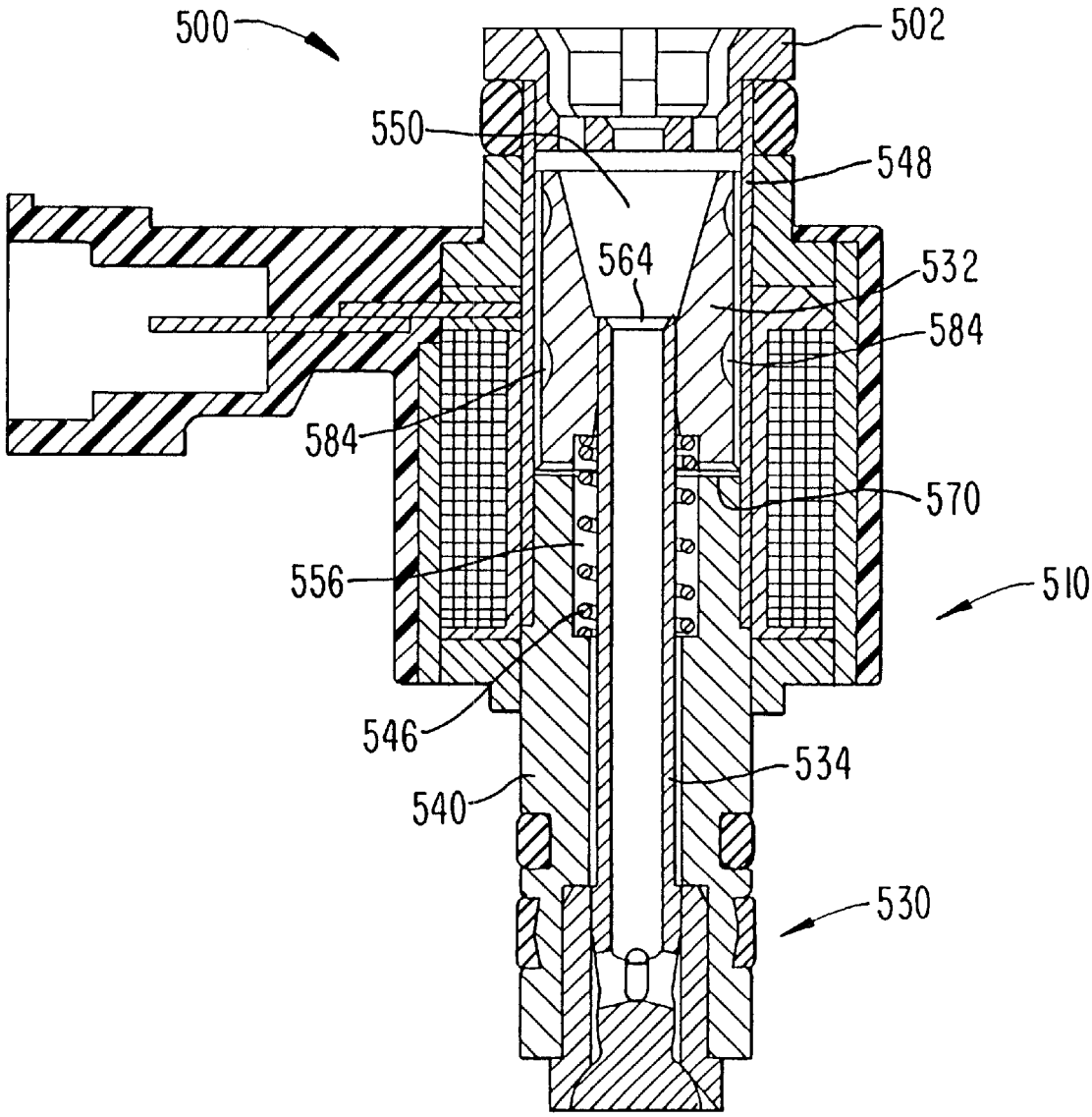
FIG. 26 illustrates another embodiment of an air assist fuel injector in accordance with the present invention.
Figure 29:
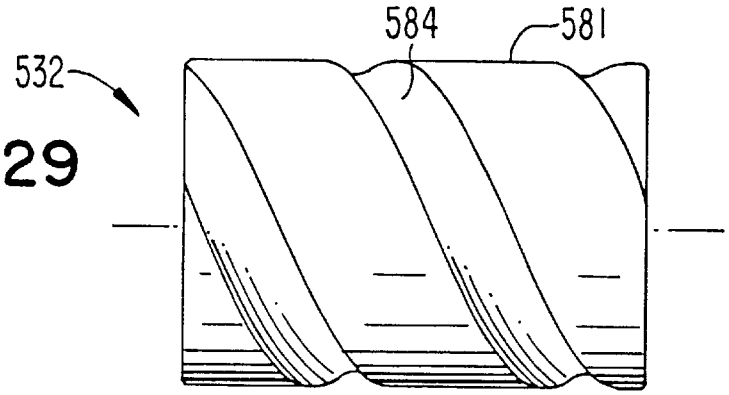
FIG. 29 illustrates a side view of the armature illustrated in FIG. 27.
Figure 28:
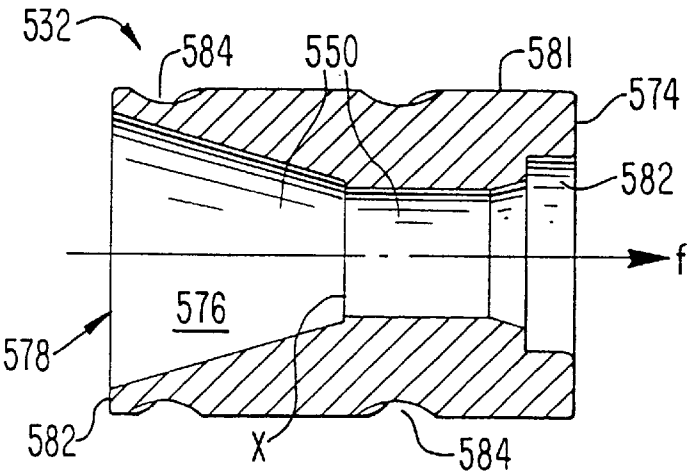
FIG. 28 illustrates a cross-sectional view of the armature illustrated in FIG. 27 taken along the line 28—28 in FIG. 27.
Figure 27:
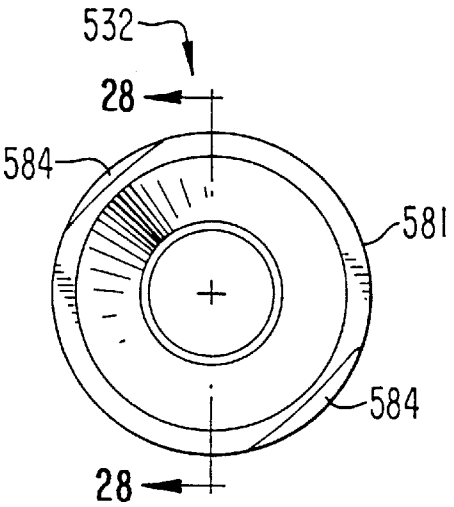
FIG. 27 illustrates an end view of the armature of the air assist fuel injector illustrated in FIG. 26.

As illustrated in FIG. 26, the air assist fuel injector 500 is identical to the air assist fuel injector 100 in all respects, except for the armature 532. As illustrated in FIGS. 26–29, the armature 532 of the air assist fuel injector 500 includes a flow path 584 that preferably extends from an area upstream of the inlet 564 of the poppet 534, in this case the area upstream of the armature 532, to an area downstream of the armature 532 with respect to the direction of flow f In the embodiment illustrated in FIGS. 26–29, the flow path 584 includes two recessed helical slots located in the cylindrical exterior surface 581 of the armature 532 that abuts the armature guide 548. The flow path 584 relieves any pressure differential between the volume between the armature 532 and the leg 540 and the volumes upstream and downstream thereof during actuation of the armature 532. Hence, the flow path 584 helps prevent hydraulic delay and/or stiction, which can cause erratic closing behavior.

Figure 30:
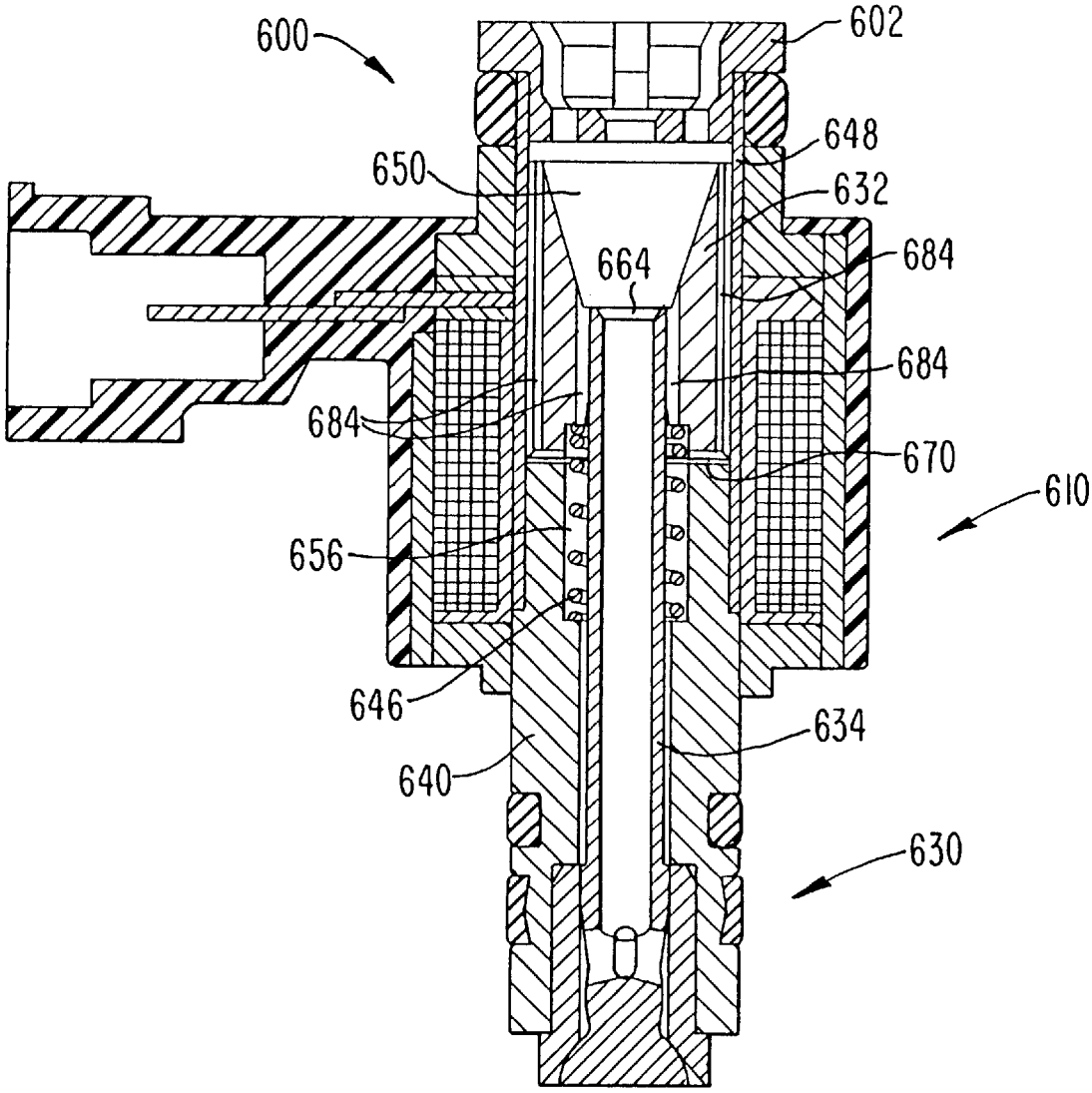
FIG. 30 illustrates a further embodiment of an air assist fuel injector in accordance with the present invention.
Figure 33:
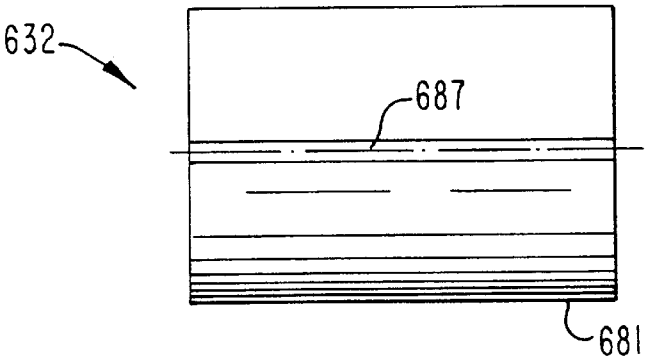
FIG. 33 illustrates a side view of the armature illustrated in FIG. 31.
Figure 32:
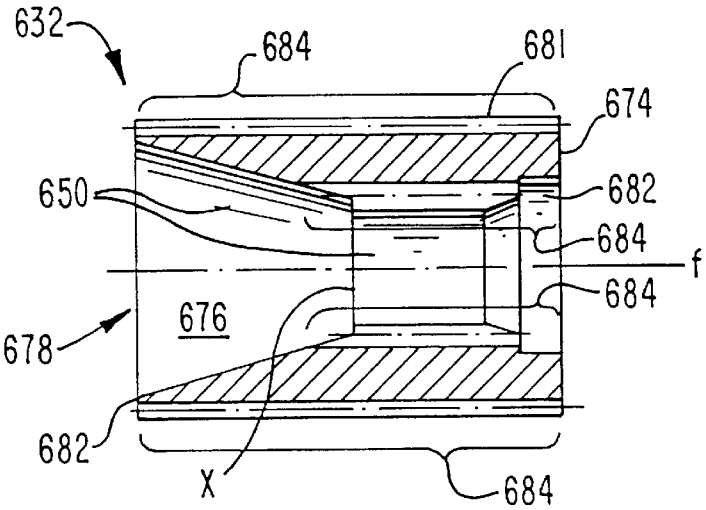
FIG. 32 illustrates a cross-sectional view of the armature illustrated in FIG. 31 taken along the line 32—32 in FIG. 31.
Figure 31:
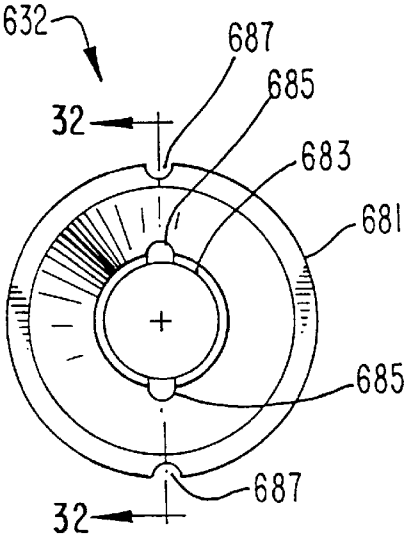
FIG. 31 illustrates an end view of the armature of the air assist fuel injector illustrated in FIG. 30.

As illustrated in FIG. 30, the air assist fuel injector 600 is identical to the air assist fuel injector 100 in all respects, except for the armature 632. As illustrated in FIGS. 30–33, the armature 632 of the air assist fuel injector 600 includes a flow path 684 that preferably extends from an area upstream of the inlet 664 of the poppet 634 to an area downstream of the armature 632 with respect to the direction of flow f. In the embodiment illustrated in FIGS. 30–33, the flow path 684 includes a portion of the recess 682 for the spring 646 as well as two recessed linear slots 685 located in the cylindrical surface 683 of the conduit 650 that abuts the poppet 634. The slots 685 are preferably located on opposite sides of the portion of the conduit 650 that receives the upstream end of the poppet 634, although the slots 685 may be located elsewhere. In the embodiment illustrated in FIGS. 30–33, the flow path 684 also includes two recessed linear slots 687 located in the cylindrical exterior surface 681 of the armature 632 that abuts the armature guide 648. The flow path 684 relieves any pressure differential between the volume between the armature 632 and the leg 640 and the volumes upstream and downstream thereof during actuation of the armature 632. Hence, the flow path 684 helps prevent hydraulic delay and/or stiction, which can cause erratic closing behavior.

Figure 34:
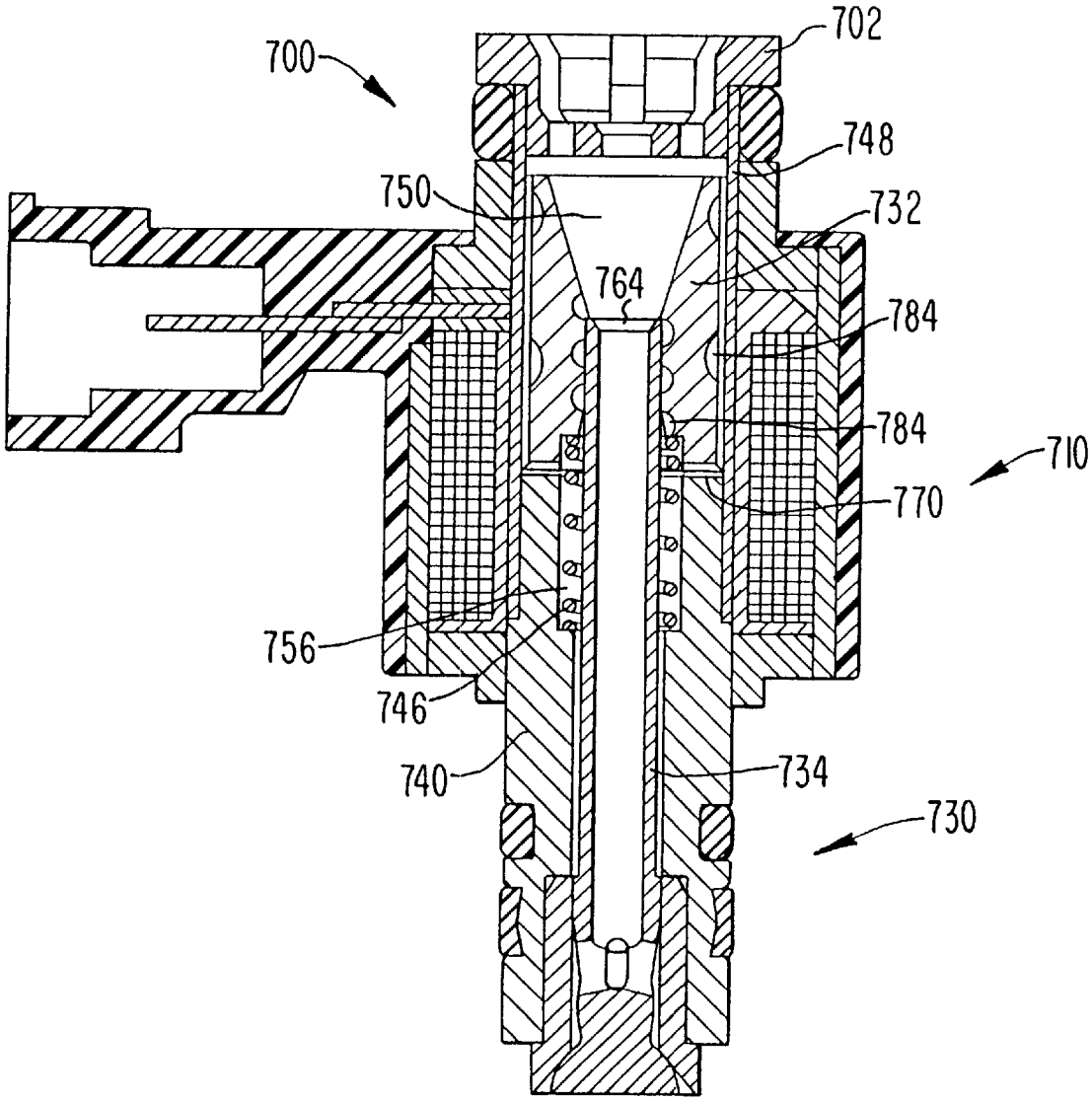
FIG. 34 illustrates another embodiment of an air assist fuel injector in accordance with the present invention.
Figure 37:
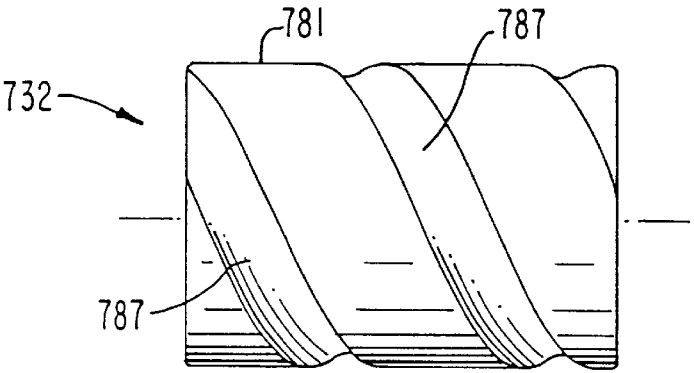
FIG. 37 illustrates a side view of the armature illustrated in FIG. 35.
Figure 36:
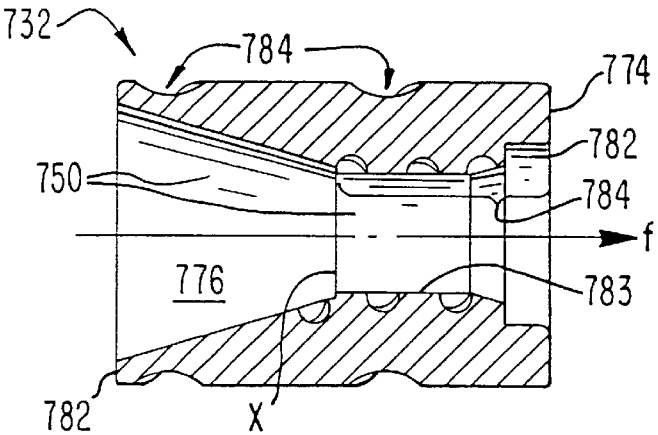
FIG. 36 illustrates a cross-sectional view of the armature illustrated in FIG. 35 taken along the line 36—36 in FIG. 35.
Figure 35:
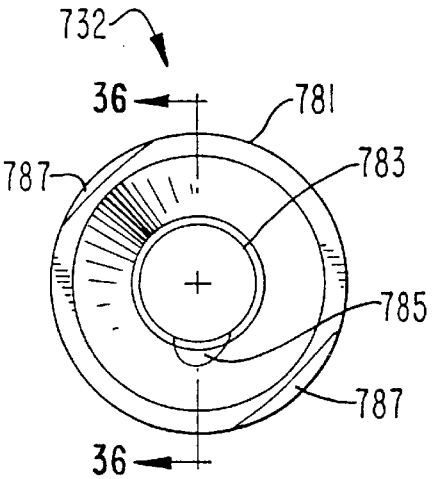
FIG. 35 illustrates an end view of the armature of the air assist fuel injector illustrated in FIG. 34.

As illustrated in FIG. 34, the air assist fuel injector 700 is identical to the air assist fuel injector 100 in all respects, except for the armature 732. As illustrated in FIGS. 34–37, the armature 732 of the air assist fuel injector 700 includes a flow path 784 that preferably extends from an area upstream of the inlet 764 of the poppet 734 to an area downstream of the armature 732 with respect to the direction of flow f. In the embodiment illustrated in FIGS. 34–37, the flow path 784 includes a portion of the recess 782 for the spring 746, as well as one recessed helical slot 785 located in the cylindrical surface 783 of the conduit 750 that abuts the poppet 734. In the embodiment illustrated in FIGS. 34–37, the flow path 784 also includes two recessed helical slots 787 located in the cylindrical exterior surface 781 of the armature 732 that abuts the armature guide 748. The flow path 784 relieves any pressure differential between the volume between the armature 732 and the leg 740 and the volumes upstream and downstream thereof during actuation of the armature 732. Hence, the flow path 784 prevents hydraulic delay and/or stiction, which can cause erratic closing behavior.

Figure 38:
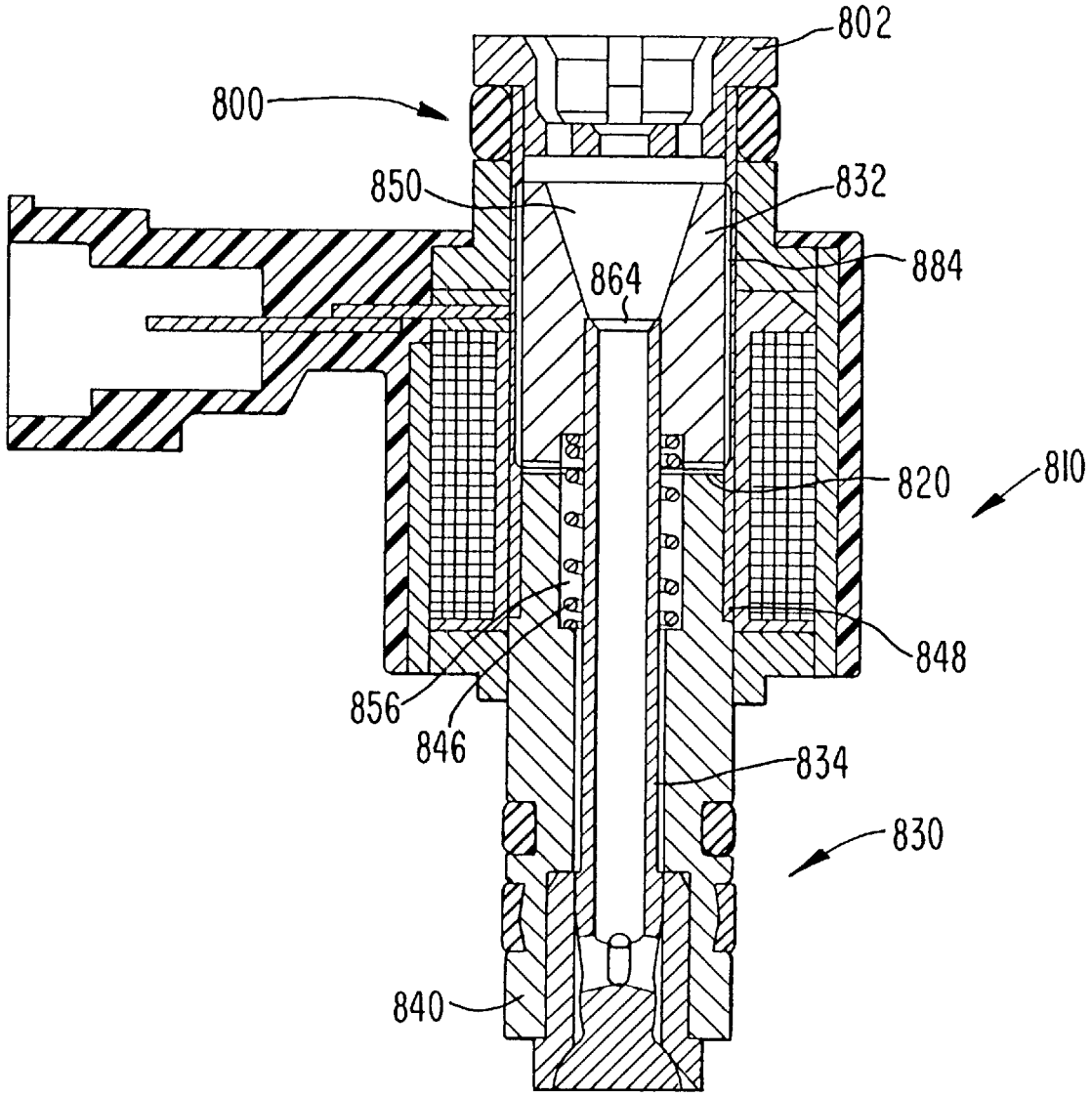
FIG. 38 illustrates another embodiment of an air assist fuel injector in accordance with the present invention.
Figure 39:
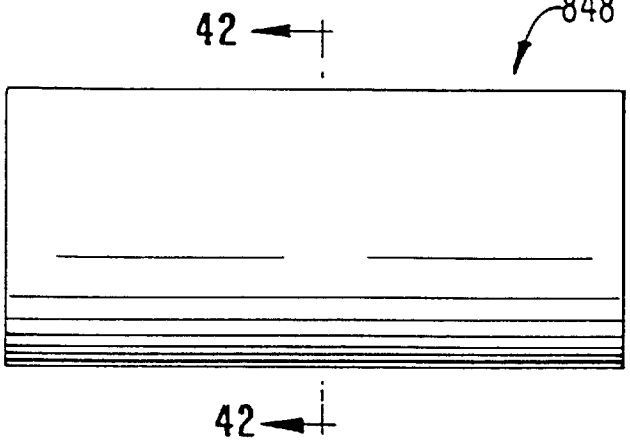
FIG. 39 illustrates a side view of an armature guide in accordance with one embodiment of the present invention.
Figure 41:
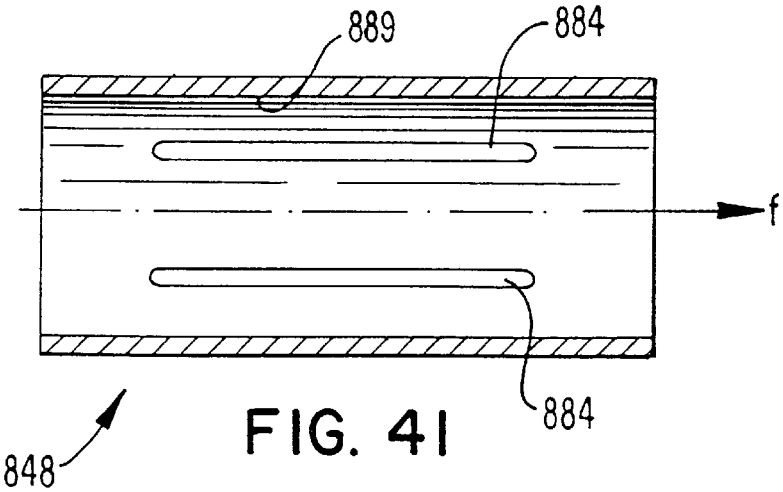
FIG. 41 illustrates a cross-sectional view of the armature guide illustrated in FIG. 39 taken along the line 41—41 in FIG. 40.
Figure 40:
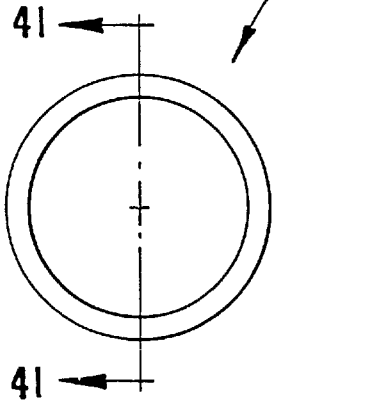
FIG. 40 illustrates an end view of the armature guide illustrated in FIG. 39.
Figure 42:
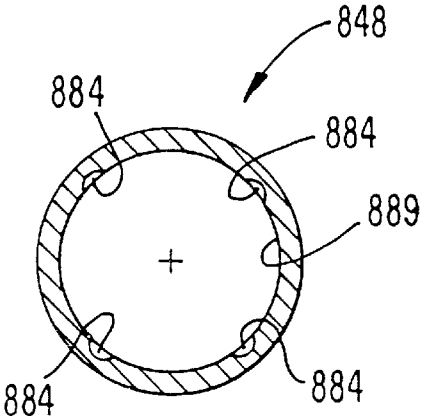
FIG. 42 illustrates a cross-sectional view of the armature guide illustrated in FIG. 39 taken along the line 42—42 in FIG. 39.

As illustrated in FIG. 38, the air assist fuel injector 800 is identical to the air assist fuel injector 100 in all respects, except for the armature guide 848. As illustrated in FIGS. 38–42, the armature guide 848 of the air assist fuel injector 800 includes a flow path 884 that preferably extends from an area upstream of the inlet 864 of the poppet 834, in this case the area upstream of the armature 832, to an area downstream of the armature 832 with respect to the direction of flow f. In the embodiment illustrated in FIGS. 38–42, the flow path 884 includes four recessed linear slots located in the cylindrical interior surface 889 of the armature guide 848 that abuts the armature 832. The flow path 884 relieves any pressure differential between the volume between the armature 832 and leg 840 and the volumes upstream and downstream thereof during actuation of the armature 832. Hence, the flow path 884 helps prevent hydraulic delay and/or stiction, which can cause erratic closing behavior.

Figure 43:
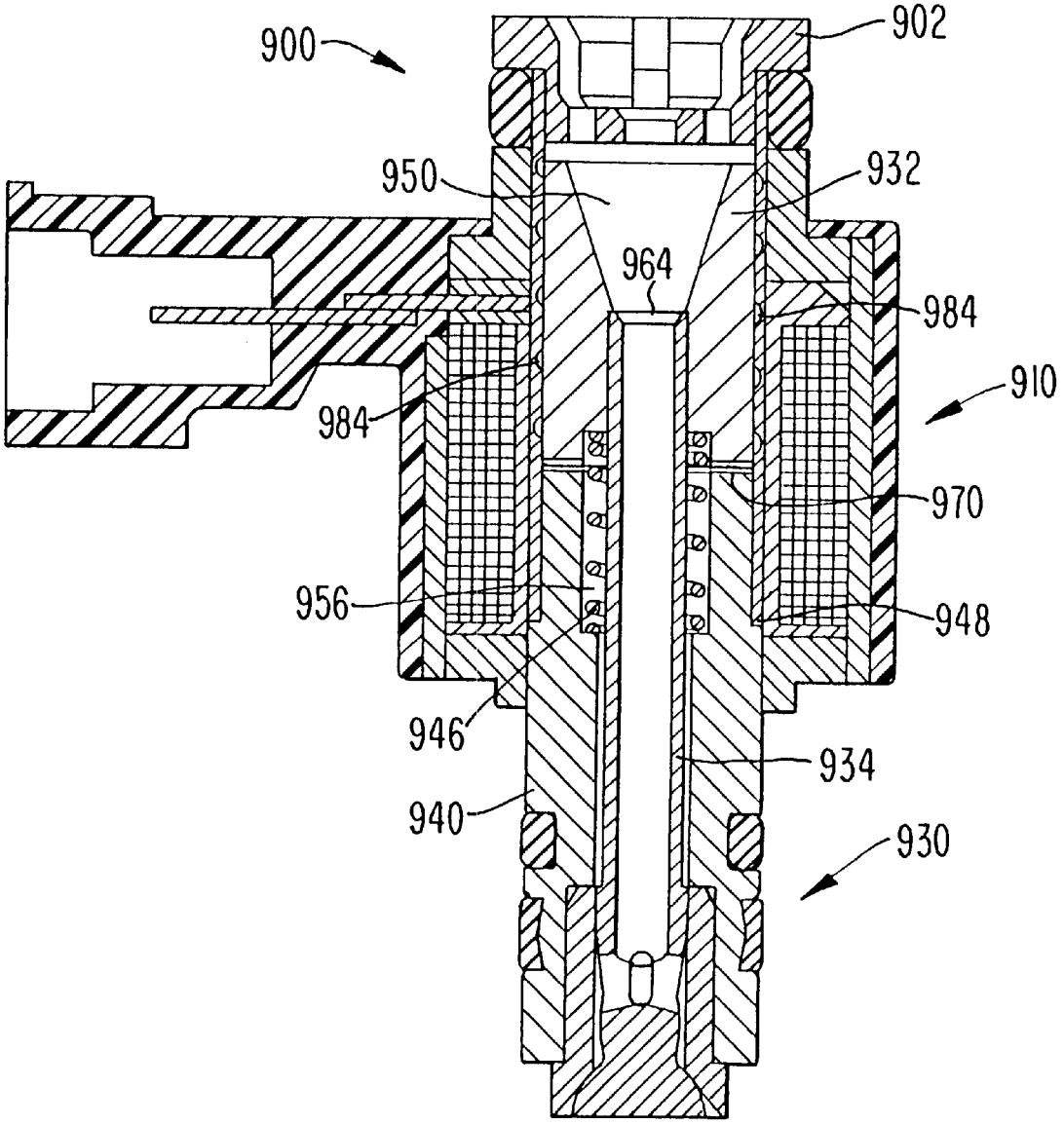
FIG. 43 illustrates a further embodiment of an air assist fuel injector in accordance with the present invention.
Figure 44:
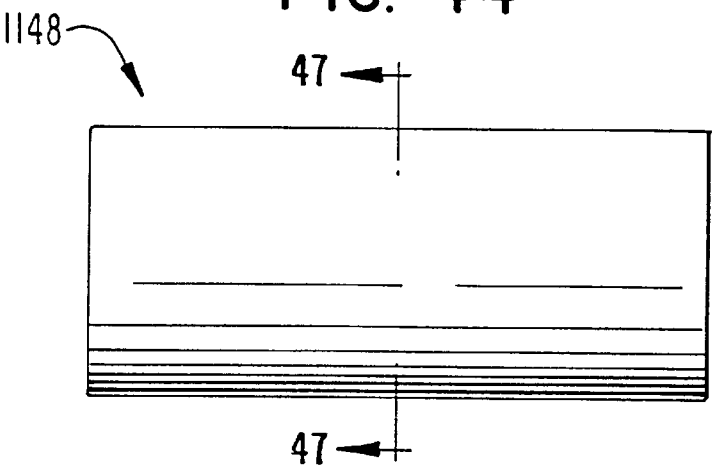
FIG. 44 illustrates a side view of an armature guide in accordance with another embodiment of the present invention.
Figure 45:
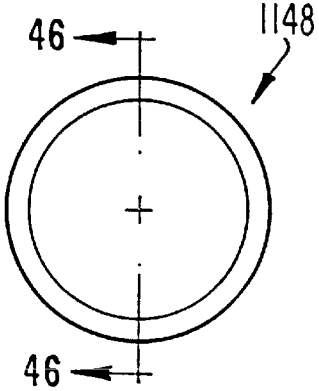
FIG. 45 illustrates an end view of the armature guide illustrated in FIG. 44.
Figure 46:
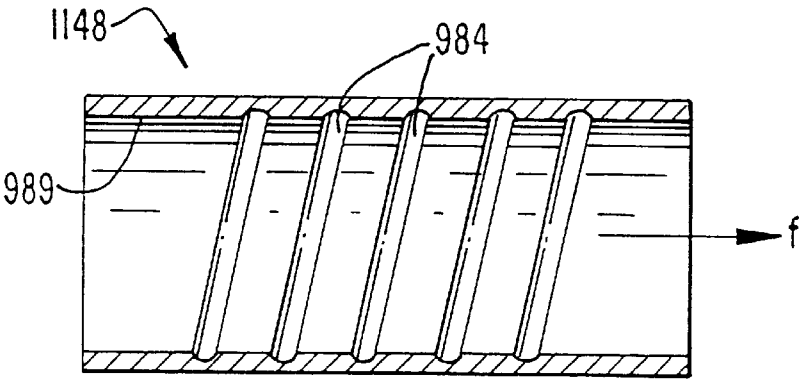
FIG. 46 illustrates a cross-sectional view of the armature guide illustrated in FIG. 44 taken along the line 46—46 in FIG. 45.
Figure 47:
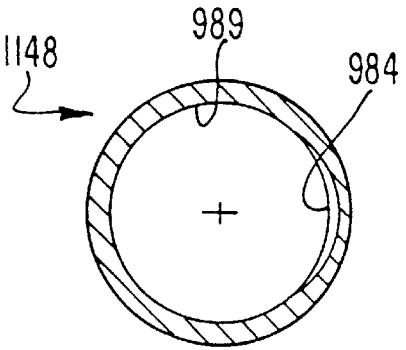
FIG. 47 illustrates a cross-sectional view of the armature guide illustrated in FIG. 44 taken along the line 47—47 in FIG. 44.

As illustrated in FIG. 43, the air assist fuel injector 900 is identical to the air assist fuel injector 100 in all respects, except for the armature guide 948. As illustrated in FIGS. flow 43–47, the armature guide 948 of the air assist fuel injector 900 includes a flow path 984 that preferably extends from an area upstream of the inlet 964 of the poppet 932, in this case the area upstream of the armature 932, to an area downstream of the armature 932 with respect to the direction of flow f. In the embodiment illustrated in FIGS. flow 43–47, the flow path 984 includes a recessed helical slot located in the cylindrical interior surface 989 of the armature guide 948 that abuts the armature 932. The flow path 984 relieves any pressure differential between the volume between the armature 932 and the leg 940 and the volumes upstream and downstream thereof during actuation of the armature 932.

Hence, the flow path 984 helps prevent hydraulic delay and/or stiction, which can cause erratic closing behavior.

Figure 48:
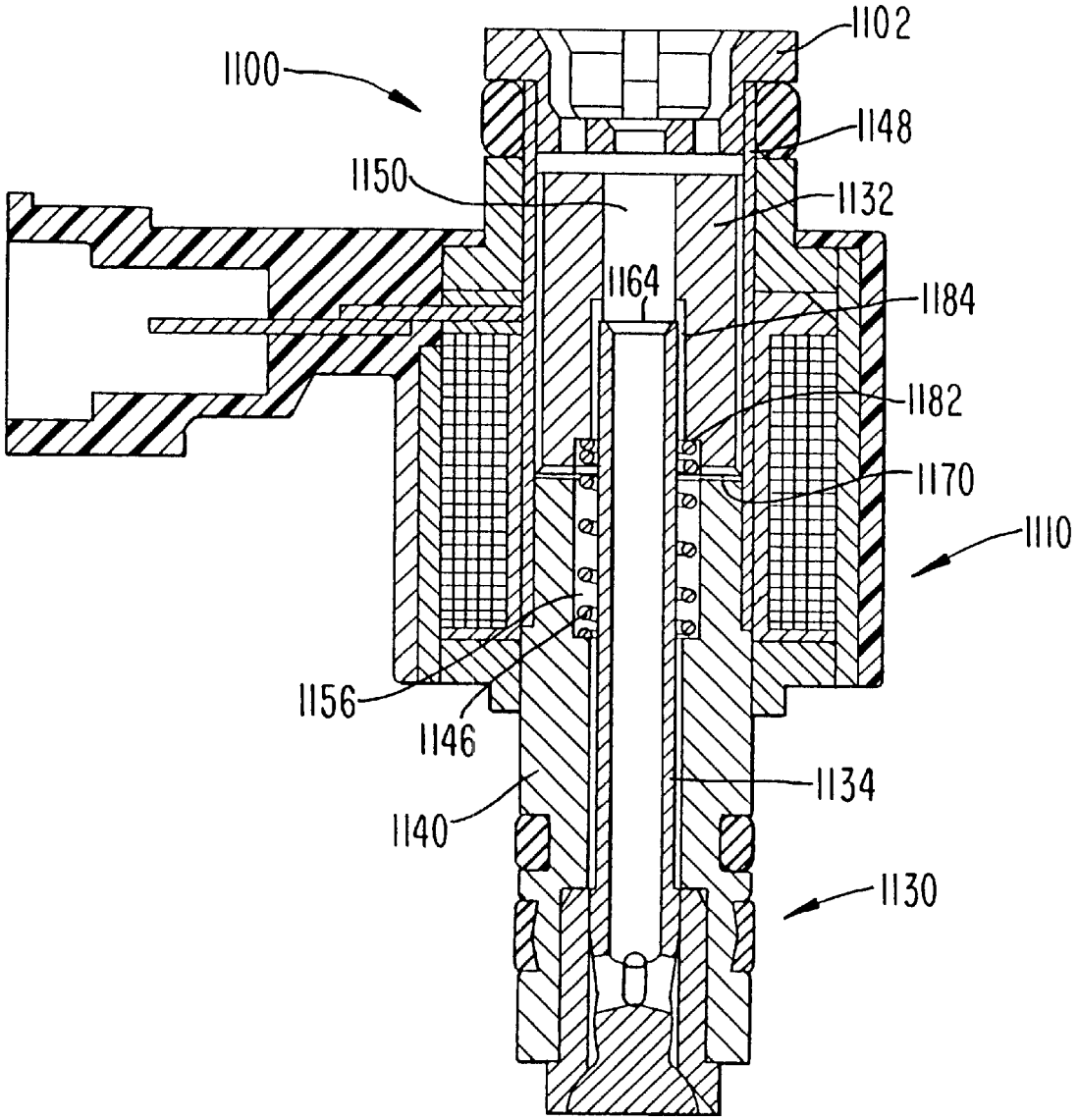
FIG. 48 illustrates another embodiment of an air assist fuel injector in accordance with the present invention.

As illustrated in FIG. 48, the air assist fuel injector 1100 is identical to the air assist fuel injector 100 in all respects, except for the armature 1134. As illustrated in FIG. 48, the armature 1132 of the air assist fuel injector 1100 includes a flow path 1184 that preferably extends from an area upstream of the inlet 1164 of the poppet 1134 to an area downstream of the armature 1132 with respect to the direction of flow f. The flow path 1184 includes a portion of the recess 1182 for the spring 1146 as well as two recessed linear slots located in the cylindrical surface of the conduit 1150 that abuts the poppet 1134. The slots are preferably located on opposite sides of the portion of the conduit 1150 that receives the upstream end of the poppet 1134. The flow path 1184 relieves any pressure differential between the volume between the armature 1132 and the leg 1140 and the volumes upstream and downstream the bore during actuation of the armature 1132. The flow path 1184 helps prevent hydraulic delay and/or stiction, which can cause erratic closing behavior. Additionally, conduit 1150 does not include a conical portion, but is entirely cylindrical. As will be appreciated, the respective conduit 250, 350, 450, 550, 650, 750, 850, 950 of the corresponding air assist fuel injector 200, 300, 400, 500, 600, 700, 800, 900 may also be entirely cylindrical so as to not include a conical portion.

It will also be appreciated that the number of recesses that define portions of the respective flow paths 284, 384, 484, 584, 684, 784, 884, 984, 1184 can vary. For example, the armature 284 may include one, four, or five recessed linear slots 285. In alternative embodiments of the air assist fuel injectors 200, 300, 400, 500, 500, 700, 800, 900, 1100, the respective armature 232, 332, 432, 532, 632, 732, 832, 932, 1132 and/or the stop surface 270, 370, 470, 570, 670, 770, 870, 970, 1170 includes a slot or a groove that extends from the corresponding spring bore 256, 356, 456, 556, 656, 756, 856, 956, 1156 to the exterior, cylindrical surface of the corresponding armature or leg. Such a slot or groove may define a portion of the respective flow path 284, 384, 484, 584, 684, 784, 884, 984, 1184 to help prevent the aforementioned hydraulic delay and/or stiction.

It is preferred that each of the flow paths 284, 384, 484, 584, 684, 784, 884, 984, 1184, have a cross sectional area that is sufficient to relieve the pressure in the bore for the spring, but also be sufficiently small so as to not substantially interfere with the delivery of liquid fuel and pressurized gas to the passageway of the respective poppets. Preferably, the net cross sectional area of one or more recesses that defines at least portion of the respective flow paths is between 0.5–2.5 $mm^2$, more preferably between 0.5–1.5 $mm^2$, and most preferably at about 1.0–1.2 $mm^2$. It will also be appreciated that the flow paths can take other configurations that those illustrated in Figures.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. An air assist fuel injector comprising:

an armature of ferromagentic material having a first end, a second end located opposite from said first end, and a conduit extending between said first end and said second end, at least a portion of said conduit being conical;

a solenoid for moving said armature when said solenoid is energized; and a poppet attached to said armature such that said poppet is actuated when said solenoid is energized, said poppet having a passageway for conveying a mixture of liquid fuel and gas, said passageway having an inlet for receiving said mixture of liquid fuel and gas, said inlet of said passageway being located downstream of said first end with respect to a direction of flow of said mixture through said air assist fuel injector.

2. The air assist fuel injector of claim 1, further comprising:

a cap located adjacent said armature and having a plurality of channels for delivering said liquid fuel and gas to said conduit of said armature, each of said plurality of channels having an inlet and an outlet and being spaced from each other, each of said outlets of said channels being located upstream of said first end of said armature with respect to said direction of flow of said mixture.

3. The air assist fuel injector of claim 2, said plurality of channels including at least one gas channel for conveying a majority of said gas of said mixture and at least one liquid fuel channel for conveying a majority of said liquid fuel of said mixture.

4. The air assist fuel injector of claim 3, said cap having one liquid fuel channel and a plurality of said gas channels.

5. The air assist fuel injector of claim 1, said inlet of said passageway being located downstream of said conical portion with respect to said direction of flow.

6. The air assist fuel injector of claim 1, further comprising an armature guide for guiding said armature, said armature guide extending from a location upstream of said armature to a location downstream of said armature.

7. The air assist fuel injector of claim 1, at least a portion of said conduit being cylindrical.

8. The air assist fuel injector of claim 7, said cylindrical portion of said conduit receiving an end portion of said poppet where said poppet is attached to said armature.

9. The air assist fuel injector of claim 7, said conical portion of said conduit being located upstream of said cylindrical portion with respect to said direction of flow of said mixture.

10. The air assist fuel injector of claim 9, said inlet of said passageway being located downstream of said conical portion of said conduit with respect to said direction of flow of said mixture.

11. The air assist fuel injector of claim 1, said conical portion of said conduit including a surface that is at an angle with respect to a center axis of said conical portion, said angle being between 10 and 45 degrees.

12. The air assist fuel injector of claim 11, said angle being between 10 and 35 degrees.

13. The air assist fuel injector of claim 12, said angle being between 15 and 25 degrees.

14. The air assist fuel injector of claim 13, said angle being approximately 16 degrees.

15. The air assist fuel injector of claim 1, said passageway of said poppet being a cylindrical passageway.

16. The air assist fuel injector of claim 1, said inlet of said passageway being located upstream of said second end of said armature with respect to said direction of flow of said mixture.

17. The air assist fuel injector of claim 1, said armature further comprising:

an exterior surface located between said first end and said second end of said armature; and a flow path recessed from said exterior surface and extending from said first end to said second end.

18. The air assist fuel injector of claim 17, said exterior surface being a cylindrical surface and said flow path including at least one groove that spirals at least partially around a circumference of said cylindrical surface.

19. The air assist fuel injector of claim 17, said exterior surface being a cylindrical surface and said flow path including at least one linear groove.

20. The air assist fuel injector of claim 1, said first end of said armature being located upstream of said second end of said armature with respect to said direction of flow, said conduit including a cylindrical portion, said conical portion of said conduit being located upstream of said cylindrical portion with respect to said direction of flow, said cylindrical portion receiving an end portion of said poppet, said cylindrical portion including a cylindrical surface and a flow path recessed from said cylindrical surface, said flow path extending from at least said conical portion to said second end.

21. The air assist fuel injector of claim 1, in combination with an air/fuel rail, said air/fuel rail including a cavity that receives a fuel injector.

22. The air assist fuel injector of claim 1, in combination with an internal combustion engine.

23. The air assist fuel injector of claim 22, said engine being a two stroke engine.

24. The air assist fuel injector of claim 22, said engine being a four stroke engine.

25. An air assist fuel injector comprising:

an armature of ferromagentic material having a first end, a second end located opposite from said first end, and a conduit extending between said first end and said second end;

a solenoid for moving said armature when said solenoid is energized;

a poppet attached to said armature such that said poppet is actuated when said solenoid is energized, said poppet having a passageway for conveying a mixture of liquid fuel and gas, said passageway having an inlet for receiving said mixture of liquid fuel and gas, said conduit receiving an end portion of said poppet, said inlet of said passageway being located within said conduit; and a flow path located between an area upstream of said inlet with respect to a direction of flow of said mixture and an area downstream of said armature with respect to said direction of flow, said flow path including at least one of a recess in a surface of said conduit and a recess in an exterior surface of said poppet.

26. The air assist fuel injector of claim 25, said flow path being said recess in said surface of said conduit.

27. The air assist fuel injector of claim 26, said surface of said conduit being a cylindrical surface.

28. The air assist fuel injector of claim 27, said recess including at least one groove in said cylindrical surface, said at least one groove spiraling at least partially around a circumference of said cylindrical surface.

29. The air assist fuel injector of claim 27, said recess including at least one linear groove in said cylindrical surface.

30. The air assist fuel injector of claim 25, said flow path being said recess in said exterior surface of said poppet.

31. The air assist fuel injector of claim 30, said exterior surface of said poppet being a cylindrical surface.

32. The air assist fuel injector of claim 31, said recess including at least one linear groove in said cylindrical surface.

33. The air assist fuel injector of claim 31, said recess including at least one groove in said cylindrical surface, said at least one groove spiraling at least partially around a circumference of said cylindrical surface.

34. The air assist fuel injector of claim 31, said conduit matingly receiving said end portion of said poppet.

35. The air assist fuel injector of claim 25, further comprising a cap having a plurality of channels for delivering said mixture of liquid fuel and gas to said conduit of said armature, each of said plurality of channels having an inlet and an outlet and being spaced from each other.

36. The air assist fuel injector of claim 25, at least a portion of said conduit being conical.

37. An air assist fuel injector comprising:

a cap having a plurality of channels for delivering a mixture of liquid fuel and gas, each of said plurality of channels having an inlet and an outlet and being spaced from each other;

an armature of ferromagentic material having a first end, a second end located opposite from said first end, and a conduit extending between said first end and said second end, said conduit having an inlet, all of said outlets of said plurality of channels being located radially inward of a periphery of said inlet of said conduit;

a solenoid for moving said armature when said solenoid is energized; and a poppet attached to said armature such that said poppet is actuated when said solenoid is energized, said poppet having a passageway for conveying a mixture of liquid fuel and gas, said passageway having an inlet for receiving said mixture of liquid fuel and gas, said inlet of said passageway being located downstream of said first end with respect to a direction of flow of said mixture.

38. The air assist fuel injector of claim 37, at least a portion of said conduit being conical.

39. The air assist fuel injector of claim 38, said inlet of said passageway being located downstream of said conical portion with respect to said direction of flow of said mixture.

40. The air assist fuel injector of claim 39, said conical portion being located upstream of said cylindrical portion with respect to a direction of flow of said mixture.

41. The air assist fuel injector of claim 37, said periphery of said inlet of said conduit being circular.

42. The air assist fuel injector of claim 37, said plurality of channels including at least two gas channels for conveying a majority of said gas of said mixture and at least one liquid fuel channel for conveying a majority of said liquid fuel of said mixture.

43. The air assist fuel injector of claim 42, said at least one liquid fuel channel being a liquid fuel channel located on a center axis of said cap, said at least two gas channels being equally and circumferentially spaced about said liquid fuel channel.

44. An air assist fuel injector comprising:

an armature of ferromagnetic material having a first end, a second end located opposite from said first end, and a conduit extending between said first end and said second end;

a solenoid for moving said armature when said solenoid is energized;

an armature guide having a passageway that receives said armature;

a poppet attached to said an-nature such that said poppet is actuated when said solenoid is energized, said poppet having a passageway for conveying a mixture of liquid fuel and gas, said passageway having an inlet for receiving said mixture of liquid fuel and gas, said inlet of said passageway being located downstream of said first end of said armature; and a flow path between an area upstream of said first end with respect to a direction of flow of said mixture and an area downstream of said second end with respect to said direction of flow, said flow path including at least one of a recess in an exterior surface of said armature and a recess in a surface of said passageway.

45. The air assist fuel injector of claim 44, said flow path being said recess in said surface of said passageway.

46. The air assist fuel injector of claim 45, said surface of said passageway being a cylindrical surface.

47. The air assist fuel injector of claim 46, said recess including at least one groove that spirals at least partially around a circumference of said cylindrical surface.

48. The air assist fuel injector of claim 46, said recess including at least one linear groove in said cylindrical surface.

49. The air assist fuel injector of claim 44, said flow path being said recess in said exterior surface of said armature.

50. The air assist fuel injector of claim 49, said exterior surface of said armature being a cylindrical surface.

51. The air assist fuel injector of claim 50, said recess including at least one linear groove in said cylindrical surface.

52. The air assist fuel injector of claim 50, said recess including at least one groove that spirals at least partially around a circumference of said cylindrical surface.

53. The air assist fuel injector of claim 44, further comprising:

a cap having a plurality of channels for delivering said mixture of liquid fuel and gas to said conduit of said armature, each of said plurality of channels having an inlet and an outlet and being spaced from each other, said passageway of said armature guide receiving at least a portion of said cap.

* * * * *

UNITED STATES PATENT AND TRADEMARK OFFICE

CERTIFICATE OF CORRECTION

PATENT NO. : 6,484,700 B1 
DATED : November 26, 2002
INVENTOR(S) : James A. Kimmel and Scott P. Dillon It is certified that error appears in the above-identified patent and that said Letters Patent is hereby corrected as shown below:

Column 17,
Line 5, change “an-nature” to -- armature --.

Column 12,
Lines 55-56, change “FIGS. flow” to -- FIGS. --.
Line 61, change “FIGS. flow” to -- FIGS. --.

Signed and Sealed this

Thirtieth Day of December, 2003

JAMES E. ROGAN
*Director of the United States Patent and Trademark Office*